US012742273B2

(12) United States Patent
Minamikawa

(10) Patent No.: US 12,742,273 B2
(45) Date of Patent: Sep. 22, 2026

(54) SEWING MACHINE, STORAGE MEDIUM STORING SEWING DATA, AND SEWN PRODUCT

(71) Applicant: BROTHER KOGYO KABUSHIKI KAISHA, Nagoya (JP)

(72) Inventor: Kanae Minamikawa, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/409,373

(22) Filed: Dec. 4, 2025

(65) Prior Publication Data

US 2026/0193823 A1 Jul. 9, 2026

(30) Foreign Application Priority Data

Jan. 8, 2025 (JP) ..... 2025-002653

(51) Int. Cl.
*D05B 19/12* (2006.01)

(52) U.S. Cl.
CPC ..... *D05B 19/12* (2013.01)

(58) Field of Classification Search
CPC ..... D05B 19/08; D05B 19/10; D05B 19/12; D05C 5/02
USPC ..... 700/136–138
See application file for complete search history.

(56) References Cited

U.S. PATENT DOCUMENTS 5,775,240 A * 7/1998 Hara ..... D05B 19/08 112/458
7,493,867 B2 * 2/2009 Asano ..... D05B 19/085 700/138
8,733,260 B2 * 5/2014 Takahata ..... D05B 19/10 112/78
9,008,818 B2 * 4/2015 Mizuno ..... D05C 5/04 700/138
2002/0038622 A1 4/2002 Omiya et al.
2020/0010992 A1 * 1/2020 Yamanashi ..... D05B 19/08

FOREIGN PATENT DOCUMENTS

JP 2002-102564 A 4/2002

* cited by examiner

*Primary Examiner* — Nathan E Durham
(74) *Attorney, Agent, or Firm* — Oliff PLC

(57) ABSTRACT

A controller of a sewing machine performs a sewing data acquisition operation of acquiring sewing data from a memory. The controller performs a unit pattern sewing operation of controlling a needle bar and a carriage based on the sewing data to sew a unit pattern on a sewing workpiece. The unit pattern sewing operation includes: performing a first operation of sewing a first polygon a first number of times based on first data; and performing a second operation of sewing a second polygon a second number of times based on second data. The first number of times is two or more times. The second number of times is two or more times. A virtual ring is circumscribed about both the first polygon and the second polygon. The second polygon has a side that intersects two sides extending from a vertex of the first polygon.

15 Claims, 8 Drawing Sheets

FIG. 2A
E1
| | D4 | D3 |
|---|---|---|
| D1 | 1 | P1 (X1, Y1) |
| | 2 | P2 (X2, Y1) |
| | 3 | P3 (X3, Y2) |
| D1 | 4 | P1 (X1, Y1) |
| | 5 | P2 (X2, Y1) |
| | 6 | P3 (X3, Y2) |
| D1 | 7 | P1 (X1, Y1) |
| | 8 | P2 (X2, Y1) |
| | 9 | P3 (X3, Y2) |
| D1 | 10 | P1 (X1, Y1) |
| | 11 | P2 (X2, Y1) |
| | 12 | P3 (X3, Y2) |
| D1 | 13 | P1 (X1, Y1) |
| | 14 | P2 (X2, Y1) |
| | 15 | P3 (X3, Y2) |
| | 16 | P1 (X1, Y1) |
| D2 | 17 | Q1 (X3, Y3) |
| | 18 | Q2 (X2, Y4) |
| | 19 | Q3 (X1, Y4) |
| | 20 | Q1 (X3, Y3) |
| | ... | ... |
| D2 | 29 | Q1 (X3, Y3) |
| | 30 | Q2 (X2, Y4) |
| | 31 | Q3 (X1, Y4) |
| | 32 | Q1 (X3, Y3) |
FIG. 2B
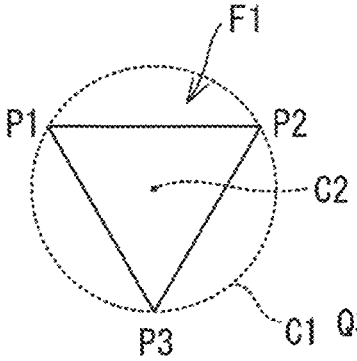
FIG. 2C
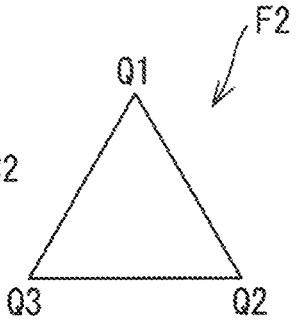
FIG. 2D
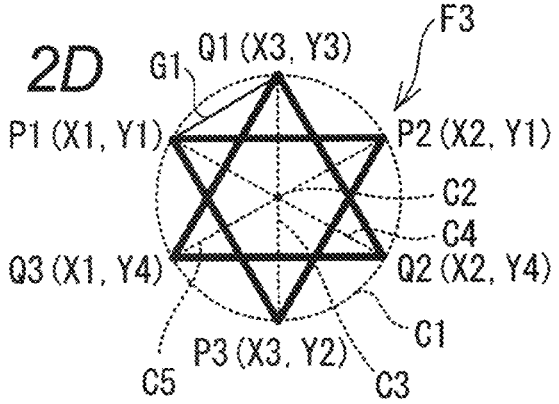
FIG. 2E
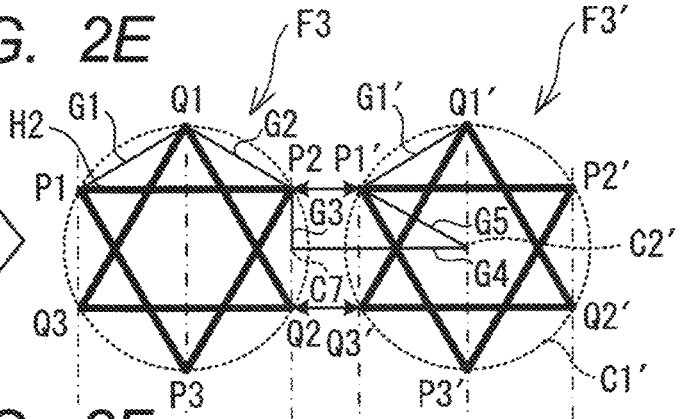
FIG. 2F
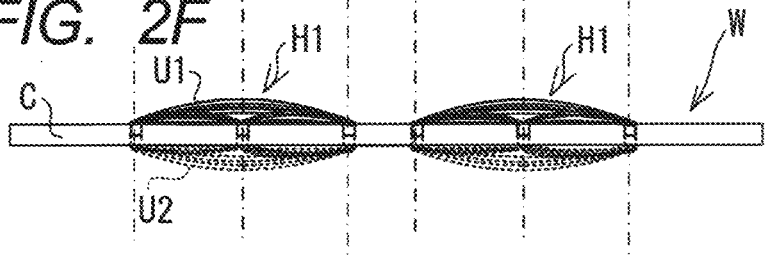

FIG. 3A
| | D4 | D3 |
|---|---|---|
| D1 | 1 | P1 (X1, Y1) |
| | 2 | P2 (X2, Y1) |
| | 3 | P3 (X3, Y2) |
| | 4 | P1 (X1, Y1) |
| | ... | ... |
| D1 | 7 | P1 (X1, Y1) |
| | 8 | P2 (X2, Y1) |
| | 9 | P3 (X3, Y2) |
| | 10 | P1 (X1, Y1) |
| D2 | 11 | Q1 (X3, Y3) |
| | 12 | Q2 (X2, Y4) |
| | 13 | Q3 (X1, Y4) |
| | 14 | Q1 (X3, Y3) |
| | ... | ... |
| D2 | 17 | Q1 (X3, Y3) |
| | 18 | Q2 (X2, Y4) |
| | 19 | Q3 (X1, Y4) |
| | 20 | Q1 (X3, Y3) |
| D1 | 21 | P2 (X2, Y1) |
| | 22 | P3 (X3, Y2) |
| | 23 | P1 (X1, Y1) |
| | 24 | P2 (X2, Y1) |
| D2 | 25 | Q2 (X2, Y4) |
| | 26 | Q3 (X1, Y4) |
| | 27 | Q1 (X3, Y3) |
| | 28 | Q2 (X2, Y4) |
| D1 | 29 | P3 (X3, Y2) |
| | 30 | P1 (X1, Y1) |
| | 31 | P2 (X2, Y1) |
| | 32 | P3 (X3, Y2) |
| D2 | 33 | Q3 (X1, Y4) |
| | 34 | Q1 (X3, Y3) |
| | 35 | Q2 (X2, Y4) |
| | 36 | Q3 (X1, Y4) |
| | 37 | P1 (X1, Y1) |
E2
FIG. 3B
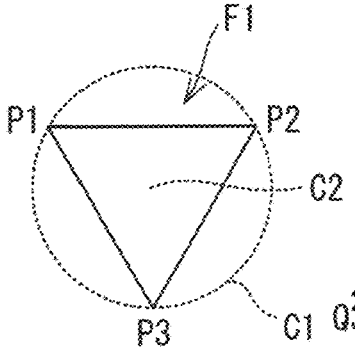
FIG. 3C
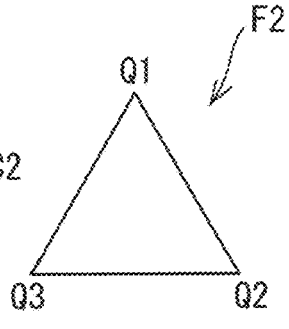
FIG. 3D
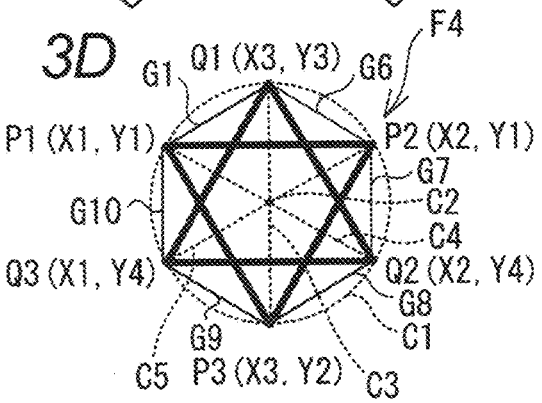
FIG. 3E
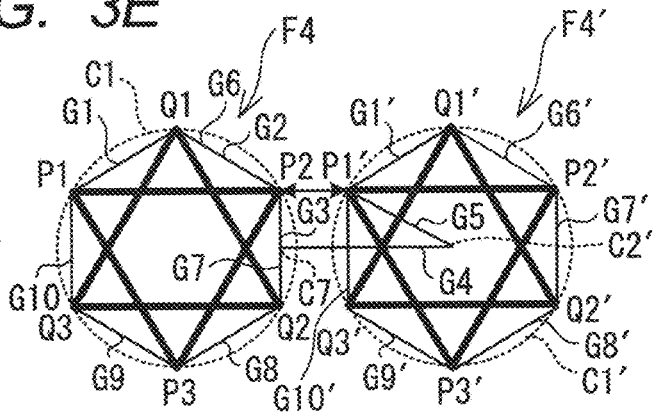

| | PATTERN | FIRST NUMBER OF TIMES SECOND NUMBER OF TIMES | PHOTO IMAGE CAPTURED FROM OBLIQUELY ABOVE | PHOTO IMAGE CAPTURED FROM SIDE |
|---|---|---|---|---|
| FIRST CONDITION | FIRST UNIT PATTERN | 5 |   |  |
| SECOND CONDITION | SECOND UNIT PATTERN | 5 |  |  |
| THIRD CONDITION | FIRST UNIT PATTERN | 2 |  |  |
| FOURTH CONDITION | SECOND UNIT PATTERN | 2 |  |  |
| FIFTH CONDITION | CONVENTIONAL ZIGZAG STITCH | – |  |  |

SEWING MACHINE, STORAGE MEDIUM STORING SEWING DATA, AND SEWN PRODUCT

REFERENCE TO RELATED APPLICATIONS

This application claims priority from Japanese Patent Application No. 2025-002653 filed on Jan. 8, 2025. The entire content of the priority application is incorporated herein by reference.

BACKGROUND ART

French knot stitching is one of the embroidery techniques for hand sewing. The French knot stitch is formed on a workpiece by piercing the workpiece with a sewing needle in a state where a thread is wound around the sewing needle and pulling out the sewing needle while tightening the wound thread.

SUMMARY

A French knot stitch is a stitch with a knot that has a three-dimensional roundness. A user of a sewing machine may wish to express a French knot stitch using a sewing machine. In order to express a French knot stitch by hand sewing, stitches of zigzag sewing is formed so as to fill a circular region. The sewing machine adjusts a thread tensioner so that a lower thread (bobbin thread) is extended to the upper surface of a sewing workpiece in order to express a three-dimensional roundness, such as a hand-sewn French knot stitch.

The sewing machine described above forms the stitches of the zigzag sewing in a circular region at a relatively high density, and thus lacks a three-dimensional feeling and cannot express a three-dimensional roundness. In the technique of putting the lower thread on the upper surface of the sewing workpiece, the finished product is not uniform and the appearance is poor.

In view of the foregoing, an example of an object of this disclosure is to provide a sewing machine, sewing data, and a sewn product which contribute to improvement of reproducibility in expressing a three-dimensional roundness of a hand-sewn French knot stitch by a sewing machine.

According to a first aspect, this specification discloses a sewing machine. The sewing machine includes a needle bar, a carriage, a memory, and a controller. An embroidery frame is attachable to the carriage. The carriage is configured to cause the embroidery frame to move relative to the needle bar. The memory is configured to store sewing data for sewing a unit pattern on a sewing workpiece held by the embroidery frame. The unit pattern is formed by overlapping a first polygon and a second polygon. The sewing data includes first data for sewing the first polygon and second data for sewing the second polygon. The second polygon is obtained by rotating the first polygon about a center of a virtual ring circumscribed about the first polygon. The controller is configured to perform a sewing data acquisition operation of acquiring the sewing data from the memory. The controller is configured to perform a unit pattern sewing operation of controlling the needle bar and the carriage based on the sewing data to sew the unit pattern on the sewing workpiece. The unit pattern sewing operation includes: performing a first operation of sewing the first polygon a first number of times based on the first data; and performing a second operation of sewing the second polygon a second number of times based on the second data. The first number of times is two or more times. The second number of times is two or more times. The virtual ring is circumscribed about both the first polygon and the second polygon. The second polygon has a side that intersects two sides extending from a vertex of the first polygon.

The sewing machine according to the first aspect performs the unit pattern sewing operation in which the first polygon is sewn two or more times and the second polygon, which is formed by rotating the first polygon, is sewn two or more times to overlap the first polygon. In the unit pattern sewing operation of the sewing machine, the sewing is performed such that the first polygon and the second polygon are inscribed in the same virtual ring. The second polygon has a side intersecting two sides extending from a vertex of the first polygon. Thus, the unit pattern sewing operation of the sewing machine contributes to improving reproducibility in the case of expressing a three-dimensional roundness of a hand-sewn French knot stitch by using the sewing machine.

According to a second aspect, this specification discloses a non-transitory computer-readable storage medium storing sewing data. The sewing data is data in which position data and a sewing order are associated with each other. The position data indicates a position of a needle drop point that is a point of piercing a sewing workpiece with a sewing needle attached to a needle bar of a sewing machine. The sewing order indicates an order in which the sewing needle pierces the sewing workpiece at the needle drop point. A first polygon and a second polygon are overlapped to form a unit pattern. The sewing data includes a first number of first data and a second number of second data. The first number is two or more. The first data indicates positions of first vertices of the first polygon as the position data. The position data of the first vertices are arranged in the sewing order. The second number is two or more. The second data indicates positions of second vertices of the second polygon as the position data. The position data of the second vertices are arranged in the sewing order. The second polygon is obtained by rotating the first polygon about a center of a virtual ring circumscribed about the first polygon. The virtual ring is circumscribed about both the first polygon and the second polygon.

In the sewing data according to the second aspect, when the sewing machine is used for sewing a unit pattern, the first polygon and the second polygon overlap each other. Thus, the sewing data contributes to sewing a unit pattern expressing a three-dimensional roundness of the hand-sewn French knot stitch. When the sewing data is used for sewing a unit pattern by the sewing machine, the first polygon and the second polygon are inscribed in the same virtual ring. Thus, the sewing data contributes to sewing a unit pattern expressing the roundness of the French knot stitch. Thus, the sewing data contributes to improving the reproducibility in expressing the three-dimensional roundness of the hand-sewn French knot stitch by the sewing machine.

According to a third aspect, this specification discloses a sewn product including a plurality of stitches of a thread for a sewing machine. The plurality of stitches connect five or more needle drop points located on a virtual ring. The five or more needle drop points include a first needle drop point, a second needle drop point next to the first needle drop point, and a third needle drop point next to the second needle drop point and different from the first needle drop point. The plurality of stitches include two or more stitches connecting the first needle drop point and the third needle drop point. The sewn product contributes to improving reproducibility of a three-dimensional roundness of the hand-sewn French knot stitch by stitches of the unit pattern using a thread for a sewing machine.

BRIEF DESCRIPTION OF DRAWINGS

FIG. 2A illustrates sewing data E1 for sewing a first unit pattern F3.

FIG. 2B illustrates a first polygon F1.

FIG. 2C illustrates a second polygon F2.

FIG. 2D illustrates the first unit pattern F3.

FIG. 2E illustrates the first unit pattern F3 and a first unit pattern F3'.

FIG. 2F illustrates stitches of the first unit pattern F3 and stitches of the first unit pattern F3' on a sewn product W.

FIG. 3A illustrates sewing data E2 for sewing a second unit pattern F4.

FIG. 3B illustrates the first polygon F1.

FIG. 3C illustrates the second polygon F2.

FIG. 3D illustrates the second unit pattern F4.

FIG. 3E illustrates the second unit pattern F4 and a second unit pattern F4'.

DESCRIPTION

Figure 1:
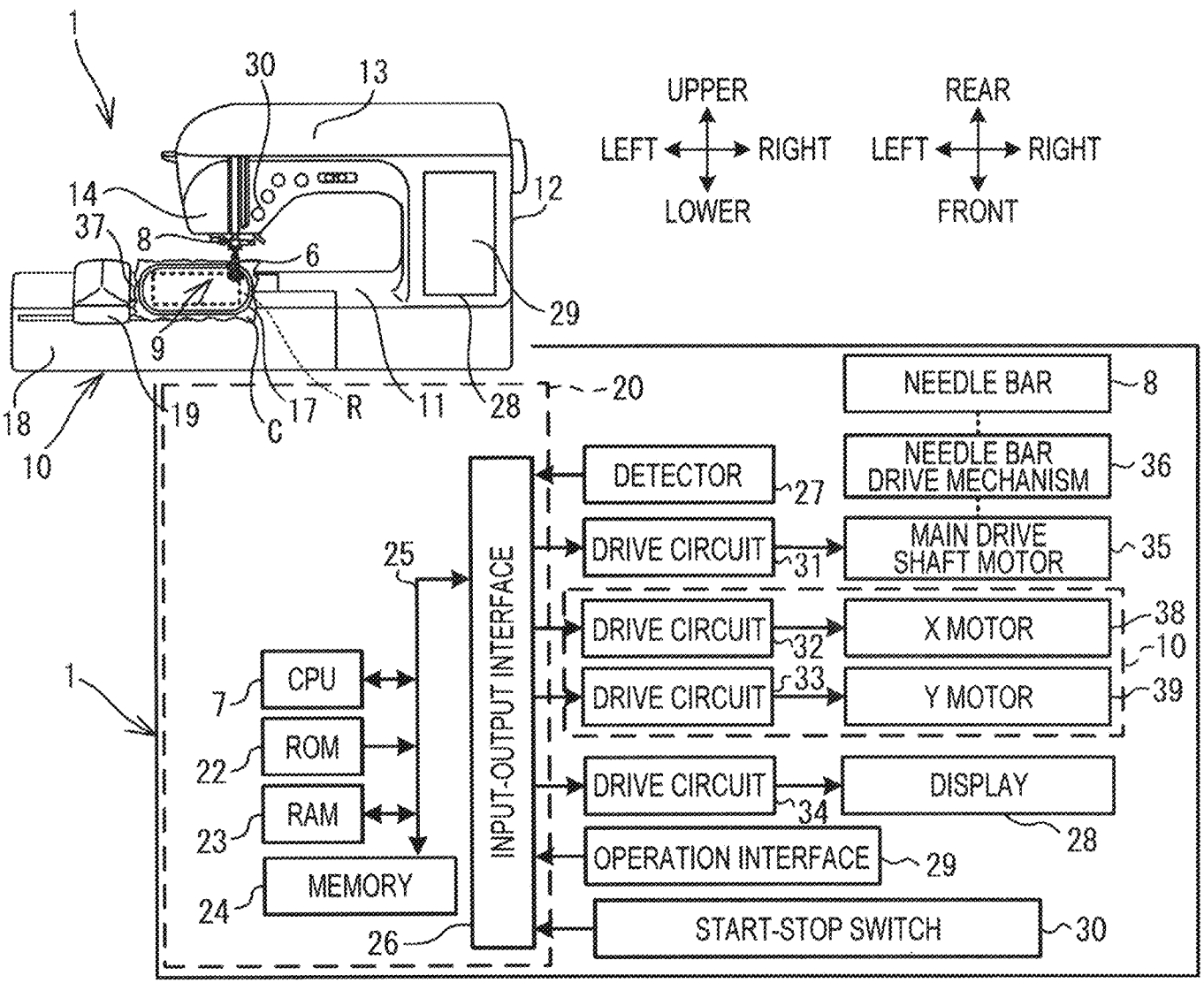
FIG. 1 is a block diagram schematically showing a configuration of an embroidery sewing machine.

An embodiment of the present disclosure will be described with reference to the drawings. As shown in FIG. 1, an embroidery sewing machine 1 (hereinafter referred to as "sewing machine") is capable of performing embroidery sewing. The sewing machine 1 includes a bed 11, a pillar 12, an arm 13, a head 14, a sewing portion 9, and a movement mechanism 10. The bed 11 is a base portion of the sewing machine 1 extending in the left-right direction.

The pillar 12 extends upward from the right end of the bed 11. A display 28 and an operation interface 29 are disposed on the front surface of the pillar 12. The display 28 is a liquid crystal display. The operation interface 29 is a touch screen.

The arm 13 extends leftward from the upper end of the pillar 12 so as to face the bed 11. The head 14 is connected to the left end of the arm 13.

The sewing portion 9 includes a presser bar, a needle bar 8, and a needle bar drive mechanism 36. A sewing needle 6 is detachably attached to the lower end of the needle bar 8. The sewing portion 9 has a hook mechanism. The sewing portion 9 forms a stitch in a sewing workpiece C by moving the needle bar 8 in the upper-lower direction.

The movement mechanism 10 includes a main body case 18 and a carriage 19. The main body case 18 houses an X-direction movement mechanism. The carriage 19 houses a Y-direction movement mechanism. The carriage 19 has a holder 37 to which an embroidery frame 17 is detachably attached. The main body case 18 is configured to move the carriage 19 in the X direction. The carriage 19 is configured to move the holder 37 in the Y direction. The movement mechanism 10 is configured to move the holder 37 relative to the needle bar 8.

At the time of embroidery sewing, a user attaches one embroidery frame 17 selected from a plurality of types of embroidery frames having different sizes on the holder 37 of the carriage 19. That is, the carriage 19 is configured to move the embroidery frame 17 attached to the holder 37 relative to the needle bar 8.

The embroidery frame 17 is moved to needle drop points indicated by an XY coordinate system unique to the sewing machine 1 by the X-direction movement mechanism and the Y-direction movement mechanism. The X direction and the Y direction in this example are the left-right direction and the front-rear direction, respectively. The XY coordinate system unique to the sewing machine 1 may be appropriately set. For example, in the XY coordinate system, the origin is set to a position of the holder 37 in a state where the carriage 19 is moved to the left end and the holder 37 is moved to the front end. The sewing machine 1 moves the embroidery frame 17 and simultaneously drives the needle bar drive mechanism 36 and the hook mechanism of the sewing portion 9. Thus, the sewing machine 1 forms a stitch on the sewing workpiece C held by the embroidery frame 17.

The electrical configuration of the sewing machine 1 will be described. The sewing machine 1 includes a CPU 7, a ROM 22, a RAM 23, a memory 24, and an input-output (I/O) interface 26. The CPU 7 controls the sewing machine 1 and is connected to the ROM 22, the RAM 23, the memory 24, and the input-output interface 26 via a bus 25. The input-output interface 26 is connected to drive circuits 31 to 34, the operation interface 29, a start-stop switch 30, and a detector 27. The detector 27 detects that the embroidery frame 17 is attached to the holder 37, and outputs a detection result corresponding to the type of the embroidery frame 17, for example, the size of the embroidery frame 17.

The memory 24 stores various setting values. The memory 24 stores pattern data for sewing an embroidery pattern including a pattern indicated by stitches in a uniform direction on the sewing workpiece C. The embroidery pattern is a pattern different from a unit pattern. The pattern indicated by stitches in the uniform direction is a pattern in which a plurality of stitches extending in the uniform direction are arranged in a specific region so as to be filled in the direction perpendicular to the uniform direction at intervals equal to or smaller than the thickness of the thread. The extending directions of the adjacent stitches in the pattern shown by the stitches in the uniform direction are not required to extend in the same direction strictly, and may be different by several degrees. The pattern shown by the stitches in the uniform direction may be shown by the stitches of a tatami stitch (fill stitch) or a satin stitch. That is, the embroidery pattern is a pattern including stitches of a tatami stitch or a satin stitch.

The memory 24 further stores sewing data for sewing a unit pattern in which a first polygon F1 and a second polygon F2 are overlapped on the sewing workpiece C held by the embroidery frame 17. The unit patterns of the present embodiment include a first type and a second type. FIG. 2D shows a first unit pattern F3 which is a first-type unit pattern, and FIG. 3D shows a second unit pattern F4 which is a second-type unit pattern. The details of the first unit pattern F3 and the second unit pattern F4 will be described later.

Each of the pattern data and the sewing data is data in which position data and a sewing order are associated with each other. The position data indicates the position of the needle drop point. The needle drop point is a point where the needle bar 8 of the sewing machine 1 is lowered and the sewing workpiece Cis pierced with the sewing needle 6 attached to the needle bar 8. The sewing order indicates the order in which the sewing needle 6 is inserted into the needle drop point.

A main drive shaft motor 35 is connected to the drive circuit 31. The drive circuit 31 drives the main drive shaft motor 35 in accordance with a control signal from the CPU 7. As the main drive shaft motor 35 is driven, the needle bar drive mechanism 36 of the sewing portion 9 is driven, and the needle bar 8 moves up and down.

An X motor 38 is connected to the drive circuit 32. A Y motor 39 is connected to the drive circuit 33. The drive circuits 32 and 33 drive the X motor 38 and the Y motor 39, respectively, in accordance with control signals from the CPU 7. As the X motor 38 and the Y motor 39 are driven, the embroidery frame 17 attached to the holder 37 moves in the left-right direction and the front-rear direction by the amount of movement corresponding to the control signal. The drive circuit 34 displays an image on the display 28 in accordance with a control signal from the CPU 7.

The first unit pattern F3 and sewing data E1 of the first unit pattern F3 will be described with reference to FIGS. 2A to 2E. As shown in FIGS. 2B to 2D, the first unit pattern F3 is a first-type unit pattern, and is a pattern in which the first polygon F1 and the second polygon F2 are overlapped. The first polygon F1 and the second polygon F2 of the present embodiment are regular polygons having sides of the same length.

As shown in FIG. 2B, the first polygon F1 of the present embodiment is a first triangle having three vertices, which are first vertices P1, P2, and P3, which are a plurality of vertices of the first polygon F1. The first polygon F1 is inscribed in a virtual ring C1. That is, the first polygon F1 is in contact with the inside of the virtual ring C1. The virtual ring C1 circumscribes the first polygon F1.

The virtual ring C1 of this embodiment is a set of points equidistant from a center C2, that is, a virtual circle. In other words, the virtual ring C1 is a circumscribed circle of the first polygon F1. The center C2 is the circumcenter of the first polygon F1. The first vertices P1, P2, and P3 are located on the virtual ring C1.

The virtual ring C1 is a virtual figure specified based on the first vertices P1, P2, and P3 indicated by the sewing data E1, and does not appear as a stitch. The diameter of the virtual ring C1 is set in consideration of the thickness of the thread, and is specifically in the range of 1 mm to 5 mm, and more specifically in the range of 2 mm to 4 mm, for example.

The second polygon F2 is a polygon obtained by rotating the first polygon F1 about the center C2 of the virtual ring C1 inscribed by the first polygon F1. That is, the second polygon F2 has the same shape as the first polygon F1. The second polygon F2 of the present embodiment is a polygon obtained by rotating the first polygon F1 by a particular angle about the center C2 of the virtual ring C1 as the rotation center. The particular angle may be set appropriately. The particular angle is, for example, an angle at which one of second vertices Q1, Q2, and Q3 is located on the median of two adjacent vertices of the first vertices P1, P2, and P3.

As shown in FIG. 2C, the second polygon F2 of the present embodiment is a second triangle having three second vertices Q1, Q2, and Q3. The first triangle and the second triangle are regular triangles having sides of the same length. The second triangle, or the second polygon F2, is inscribed in the virtual ring C1. The virtual ring C1 inscribed by the first triangle and the second triangle is a virtual circle. The second vertices Q1, Q2, and Q3 are located on the virtual ring C1.

The second vertex Q1 of the second polygon F2 is disposed on a median C3 of the first vertices P1 and P2 adjacent to each other in the first polygon F1. The second vertex Q2 of the second polygon F2 is disposed on a median C4 of the first vertices P2 and P3 adjacent to each other in the first polygon F1. The second vertex Q3 of the second polygon F2 is disposed on a median C5 of the first vertices P3 and P1 adjacent to each other in the first polygon F1.

The second triangle, that is, the second polygon F2 is a regular triangle obtained by rotating the first triangle, that is, the first polygon F1 by 180 degrees about the center C2 of the virtual ring C1 as the rotation center. As shown in FIG. 2D, the first and second vertices are alternately arranged on the virtual ring C1. On the virtual ring C1, the intervals between the adjacent vertices are the same.

The second polygon F2 has a side intersecting two sides passing through a vertex of the first polygon F1. Each of the sides of the second polygon F2 intersects with two sides passing through one vertex of the first polygon F1 disposed on an arc where one side of interest is a chord of the virtual ring C1. The side connecting the second vertices Q1 and Q2 intersects with each of the two sides extending from the first vertex P2 disposed on the arc connecting the second vertices Q1 and Q2. The two sides extending from the first vertex P2 are a side connecting the first vertices P2 and P1 and a side connecting the first vertices P2 and P3. The side connecting the second vertices Q2 and Q3 intersects with each of the two sides extending from the first vertex P3 disposed on the arc connecting the second vertices Q2 and Q3. The two sides extending from the first vertex P3 are a side connecting the first vertices P3 and P1 and a side connecting the first vertices P3 and P2. The side connecting the second vertices Q3 and Q1 intersects with each of the two sides extending from the first vertex P1 disposed on the arc connecting the second vertices Q3 and Q1. The two sides extending from the first vertex P1 are a side connecting the first vertices P1 and P2 and a side connecting the first vertices P1 and P3.

The sewing data E1 of the first unit pattern F3 is data in which position data D3 and a sewing order D4 are associated with each other. The position data D3 may be data indicating the position of the needle drop point, and in the present embodiment, is indicated by coordinates of the XY coordinate system unique to the sewing machine 1. The coordinates of the XY coordinate system may be absolute coordinates or relative coordinates. For example, the position data having the first vertex P1 as the needle drop point is represented by coordinates (X1, Y1), and is associated with the sewing order "1". The sewing data E1 includes two or more (first number of) first data D1 and two or more (second number of) second data D2.

The first data D1 is data for sewing the first polygon F1. The first data D1 includes data for forming three stitches connecting the first vertices P1, P2, and P3 of the first polygon F1 in the sewing order. More specifically, the first data D1 includes position data having the first vertices P1, P2, P3, and P1 as needle drop points, for example. Each side of the first polygon F1 is indicated by one stitch. That is, no needle drop points other than the first vertex are set on each side of the first polygon F1. In the triangular region surrounded by the three sides of the first polygon F1, the needle drop point indicated by the first data D1 does not exist. The sewing order of the position data included in the first data D1 may be changed as appropriate.

The second data D2 is data for sewing the second polygon F2. The second data D2 includes data for forming three stitches connecting the second vertices Q1, Q2, and Q3 of the second polygon F2 in the sewing order. More specifically, the second data D2 includes position data having the second vertices Q1, Q2, Q3, and Q1 as needle drop points, for example. Each side of the second polygon F2 is indicated by one stitch. That is, no needle drop points other than the second vertex are set on each side of the second polygon F2. In the triangular region surrounded by the three sides of the second polygon F2, the needle drop point indicated by the second data D2 does not exist. The sewing order of the position data included in the second data D2 may be changed as appropriate.

The first number and the second number may be set appropriately in consideration of the diameter of the virtual ring C1 and the thickness of the thread. The first number and the second number in this embodiment are the same number. Each of the first number and the second number is a number of 5 or less. Each of the first number and the second number is five.

When sewing the first unit pattern F3, the sewing machine 1 performs a first operation a first number of times and performs a second operation a second number of times. The first operation is a process of sewing the first polygon F1 based on the first data D1. The second operation is a process of sewing the second polygon F2 based on the second data D2. The first number of times corresponds to the first number. The second number of times corresponds to the second number. That is, each of the first number of times and the second number of times in this embodiment is five times.

In FIG. 2A, five first data D1 are shown, and a part of second data D2 is omitted. The sewing data E1 includes five first data D1 consecutively. The first vertex P1, which is sewn last in the first run of the first operation, is the same as the first vertex P1 sewn first in the second run of the first operation. Thus, they share the same sewing order and position data. The sewing data E1 includes five second data D2 consecutively. The second vertex Q1, which is sewn last in the first run of the second operation, is the same as the second vertex Q1 sewn first in the second run of the second operation. Thus, they share the same sewing order and position data.

The sewing machine 1 performs sewing in accordance with the sewing data E1, thereby consecutively performing the first operation a first number of times. Thereafter, the sewing machine 1 consecutively performs the second operation a second number of times. Each side of the first polygon F1 is represented by five overlapping stitches. Each side of the second polygon F2 is represented by five overlapping stitches. A stitch G1 which is a jump stitch is formed between the first vertex P1 and the second vertex Q1.

The first unit pattern F3 is formed by sewing stitches indicating the second polygon F2 on stitches indicating the first polygon F1, and thus, the shape of the second polygon F2 is emphasized. Thus, in the first unit pattern F3, the stitches indicating the second polygon F2 are arranged in an orderly manner as compared with the second unit pattern F4 described later, and a glossy feeling like satin is expressed.

The sides of the first polygon F1 and the sides of the second polygon F2 form a polygon inside the virtual ring C1. The polygon formed inside the virtual ring C1 is a polygon connecting the intersection points of the sides of the first polygon F1 and the sides of the second polygon F2. The polygon formed inside the virtual ring C1 of this embodiment is a regular polygon, and more specifically, a regular hexagon centered on the center C2. The polygon formed inside the virtual ring C1 is a regular polygon centered on the center C2 at a position close to the center C2. Since the stitches showing a regular hexagon centered on the center C2 are formed inside the virtual ring C1, the stitches of the first unit pattern F3 express a dome-shaped three-dimensional roundness in a side view.

At the beginning of sewing, a needle drop point may be added between the first vertex P1 of the sewing order "1" and the first vertex P2 of the sewing order "2" in order to prevent thread slippage. That is, at the beginning of sewing, a needle drop point for forming a reverse stitch may be added in order to prevent thread slippage.

The arrangement of the first unit patterns F3 in a case where a plurality of the first unit patterns F3 are consecutively sewn will be described with reference to FIG. 2E. For convenience of description, one first unit pattern F3 and another first unit pattern F3 are distinguished by adding a dash to the end of the reference sign. More specifically, the other first unit pattern F3 is represented by a reference sign F3' in which a dash is added to the end of the reference sign of the first unit pattern F3.

The first unit pattern F3 and the first unit pattern F3' have the same shape. For example, the first unit pattern F3' has first vertices P1', P2', and P3' corresponding to the first vertices P1, P2, and P3 of the first unit pattern F3. The first vertices P1', P2', and P3' are points obtained by moving the first vertices P1, P2, and P3 of the first unit pattern F3 to the right by a particular distance, respectively. The first unit pattern F3' has second vertices Q1', Q2', and Q3' corresponding to the second vertices Q1, Q2, and Q3 of the first unit pattern F3. The second vertices Q1', Q2', and Q3' are points obtained by moving the second vertices Q1, Q2, and Q3 to the right by the particular distance, respectively.

When a plurality of first unit patterns F3 are sewn consecutively, the first unit pattern F3' is disposed at a position where the first unit pattern F3' does not overlap the first unit pattern F3. Position data for forming stitches connecting the first unit pattern F3 and the first unit pattern F3' is added between the sewing data E1 of the first unit pattern F3 and the sewing data of the first unit pattern F3'. The stitches connecting the first unit pattern F3 and the first unit pattern F3' include, for example, stitches G2, G3, G4 and G5.

The stitch G2 is a jump stitch connecting the second vertex Q1 and the first vertex P2. The stitch G3 is a jump stitch connecting the first vertex P2 and a midpoint C7 of the first vertex P2 and the second vertex Q2. The stitch G4 is a jump stitch connecting the midpoint C7 and a center C2' of a virtual ring C1' of the first unit pattern F3'. When sewing jump stitches connecting the unit patterns, the stitch having the center C2' as one end is formed, and thus the route of the thread is arranged neatly. The stitch G5 is a jump stitch connecting the center C2' and the first vertex P1'.

The distance between the first unit pattern F3 and the first unit pattern F3' is 0.7 mm or more, for example. The distance between the first unit pattern F3 and the first unit pattern F3' may be measured by the distance between the nearest vertices among the vertices of the first unit pattern F3 and the first unit pattern F3'. The distance between the first unit pattern F3 and the first unit pattern F3' in this embodiment is represented by a linear distance between the first vertex P2 of the first unit pattern F3 and the first vertex P1' of the first unit pattern F3'. The distance between the first unit pattern F3 and the first unit pattern F3' may be the distance between the closest positions of the virtual ring C1 of the first unit pattern F3 and the virtual ring C1' of the first unit pattern F3'. When the distance between two adjacent unit patterns is 0.7 mm or more, the sewing machine 1 and the sewing data have the following effects as compared with the case where the distance is less than 0.7 mm. That is, the sewing machine 1 and the sewing data contribute to reducing the possibility that a needle drop point of the first unit pattern F3 and a needle drop point of the first unit pattern F3' are set at the same position.

The memory 24 may store sewing data for consecutively sewing a plurality of first unit patterns F3, including position data for forming jump stitches connecting the first unit pattern F3 and the first unit pattern F3'. The CPU 7 may add position data for forming stitches connecting the first unit pattern F3 and the first unit pattern F3' at the time of sewing based on the sewing data E1 of the first unit pattern F3 stored in the memory 24.

In the first unit pattern F3, the number of overlapping stitches of the jump stitches connecting any two adjacent vertices on the virtual ring C1 is 0, 1, or 2. The needle drop point located at the center C2' of the virtual ring C1' for forming a jump stitch is formed in the triangular region surrounded by three sides of the first polygon F1 and in the triangular region surrounded by three sides of the second polygon F2. No other needle drop points are formed in the triangular regions.

A first needle drop point P1, a second needle drop point Q1, and a third needle drop point P2 are defined among the needle drop points P1, Q1, P2, Q2, P3, and Q3 of the first unit pattern F3. The second needle drop point Q1 is a point which is disposed next to the first needle drop point P1 on the virtual ring C1. The third needle drop point P2 is a point which is disposed next to the second needle drop point Q1 and is different from the first needle drop point P1 on the virtual ring C1.

FIG. 2F schematically shows a plurality of stitches of a unit pattern of a sewn product W on which the unit pattern is sewn. The sewn product W on which the unit pattern is sewn has a plurality of stitches H1 which connect five or more needle drop points located on the virtual ring C1. The plurality of stitches H1 include a stitch H2 connecting the first needle drop point P1 and the third needle drop point P2. The stitch H2 includes two or more stitches, and in this embodiment, the stitch H2 includes five stitches which are the first number of stitches. The same relationship is satisfied when a point other than the needle drop point P1 among the needle drop points P1, Q1, P2, Q2, P3, and Q3 is defined as the first needle drop point.

The number of stitches of the jump stitch connecting the first needle drop point P1 and the second needle drop point Q1 is one, and is smaller than five, which is the number of stitches connecting the first needle drop point P1 and the third needle drop point P2. When a fourth needle drop point Q2 which is disposed next to the third needle drop point P2 and is different from the second needle drop point Q1 is defined, the unit pattern does not have a stitch connecting the first needle drop point P1 and the fourth needle drop point Q2.

The plurality of stitches of the unit pattern are stitches in which an upper thread (needle thread) U1 indicated by solid lines and a lower thread (bobbin thread) U2 indicated by dotted lines different from the upper thread U1 are entangled with each other. The upper thread U1 and the lower thread U2 of this embodiment are threads having different colors from each other. The unit pattern of the present embodiment realizes various expressions using the sewing machine 1 by combining the upper thread U1 and the lower thread U2 having different colors.

Sewing data E2 of the second unit pattern F4 will be described with reference to FIGS. 3A to 3E. As shown in FIGS. 3B to 3D, the second unit pattern F4 is a second-type unit pattern, and is a pattern in which the first polygon F1 and the second polygon F2 are overlapped. The first polygon F1 and the second polygon F2 are the same as those described for the first unit pattern F3.

The sewing data E2 of the second unit pattern F4 is data in which position data D3 and a sewing order D4 are associated with each other. The sewing data E2 includes a first number of first data D1 and a second number of second data D2.

When sewing the second unit pattern F4, the sewing machine 1 performs the first operation a first number of times and performs the second operation a second number of times. More specifically, the sewing machine 1 performs the first operation three times consecutively and then performs the second operation three times consecutively. Thereafter, the sewing machine 1 alternately performs the first operation and the second operation a plurality of times. The plurality of times in this embodiment is twice. That is, each of the first number of times and the second number of times in this embodiment is five times.

In FIG. 3A, the first data D1 and the second data D2 are partially omitted. The sewing data E2 includes three first data D1 consecutively. The first vertex P1, which is sewn last in the first run of the first operation, is the same as the first vertex P1 sewn first in the second run of the first operation. Thus, they share the same sewing order and position data.

The sewing data E2 includes three second data D2 consecutively. The second vertex Q1, which is sewn last in the first run of the second operation, is the same as the second vertex Q1 sewn first in the second run of the second operation. Thus, they share the same sewing order and position data.

The start point and the end point of the first data D1 for performing the first to third runs of the first operation are the first vertex P1. The start point and the end point of the first data D1 for performing the fourth run of the first operation are the first vertex P2. The start point and the end point of the first data D1 for performing the fifth run of the first operation are the first vertex P3.

The start point and the end point of the second data D2 for performing the first to third runs of the second operation are the second vertex Q1. The start point and the end point of the second data D2 for performing the fourth run of the second operation are the second vertex Q2. The start point and the end point of the second data D2 for performing the fifth run of the second operation are the second vertex Q3.

The sewing machine 1 performs sewing in accordance with the sewing data E2, and thereby, the first operation is performed three times consecutively and then the second operation is performed three times consecutively. Thereafter, the sewing machine 1 alternately performs the first operation and the second operation twice. Each side of the first polygon F1 is represented by five overlapping stitches. Each side of the second polygon F2 is represented by five overlapping stitches.

In the second unit pattern F4, the first polygon F1 and the second polygon F2 are alternately overlapped, and thus the mixture of the two polygons is emphasized. Thus, the second unit pattern F4 has stitches arranged in a more intertwined manner than the first unit pattern F3, and expresses a finer three-dimensional effect.

The stitch G1 of a jump stitch is formed between the first vertex P1 and the second vertex Q1. A stitch G6 of a jump stitch is formed between the second vertex Q1 and the first vertex P2. A stitch G7 of a jump stitch is formed between the first vertex P2 and the second vertex Q2. A stitch G8 of a jump stitch is formed between the second vertex Q2 and the first vertex P3. A stitch G9 of a jump stitch is formed between the first vertex P3 and the second vertex Q3. A stitch G10 of a jump stitch is formed between the second vertex Q3 and the first vertex P1. That is, the second unit pattern F4 has one stitch connecting each of adjacent vertices on the virtual ring C1.

Referring to FIG. 3E, a case where a plurality of second unit patterns F4 are sewn consecutively will be described. For convenience of description, one second unit pattern F4 and another second unit pattern F4 are distinguished by adding a dash to the end of the reference sign. More specifically, the other second unit pattern F4 is represented by a reference sign F4' in which a dash is added to the end of the reference sign of the first second unit pattern F4.

When a plurality of second unit patterns F4 are sewn consecutively, the second unit pattern F4' is disposed at a position where the second unit pattern F4' does not overlap the second unit pattern F4. Position data for forming stitches connecting the second unit pattern F4 and the second unit pattern F4' is added between the sewing data E2 of the second unit pattern F4 and the sewing data of the second unit pattern F4'. The stitches connecting the second unit pattern F4 and the second unit pattern F4' are set appropriately. The stitches connecting the second unit pattern F4 and the second unit pattern F4' include, for example, stitches G2 to G5. The stitch G2 is formed at the same position as the stitch G6. The stitch G3 is disposed at a position where a part of the stitch G3 overlaps the stitch G7.

The distance between the second unit pattern F4 and the second unit pattern F4' is 0.7 mm or more, for example. The distance between the second unit pattern F4 and the second unit pattern F4' may be measured by the distance between the nearest vertices among the vertices of the respective second unit patterns F4 and F4'. The memory 24 may store sewing data for consecutively sewing a plurality of second unit patterns F4, including position data for forming stitches of a jump stitch connecting the second unit pattern F4 and the second unit pattern F4'. The position data for forming stitches connecting the second unit pattern F4 and the second unit pattern F4' may be added to the memory 24 at the time of sewing, based on the sewing data E2 of the second unit pattern F4.

In the second unit pattern F4, the number of overlapping stitches of the jump stitch connecting any two adjacent vertices on the virtual ring C1 is one or two. That is, the second unit pattern F4 has a portion where the stitches of the jump stitch overlap each other up to twice. The needle drop point located at the center C2' of the virtual ring C1' for forming a jump stitch is formed in the triangular region surrounded by three sides of the first polygon F1 and in the triangular region surrounded by three sides of the second polygon F2. No other needle drop points are formed in the triangular regions. In the second unit pattern F4, the number of overlapping stitches of the jump stitch connecting any two adjacent vertices on the virtual ring C1 is two when the stitches of the jump stitch connecting the two second unit patterns F4 and F4' are formed. That is, in a case where one second unit pattern F4 is sewn and no stitch of the jump stitch connecting the two second unit patterns F4 and F4' is formed, the number of overlapping stitches of the jump stitch connecting any two vertices is one.

In the second unit pattern F4, as in the first unit pattern F3, the three sides of the first polygon F1 and the three sides of the second polygon F2 form a polygon inside the virtual ring C1. The polygon formed inside the virtual ring C1 is a polygon connecting the intersection points of the sides of the first polygon F1 and the sides of the second polygon F2. The polygon formed inside the virtual ring C1 of this embodiment is a regular polygon, and more specifically, a regular hexagon centered on the center C2.

Figure 4:
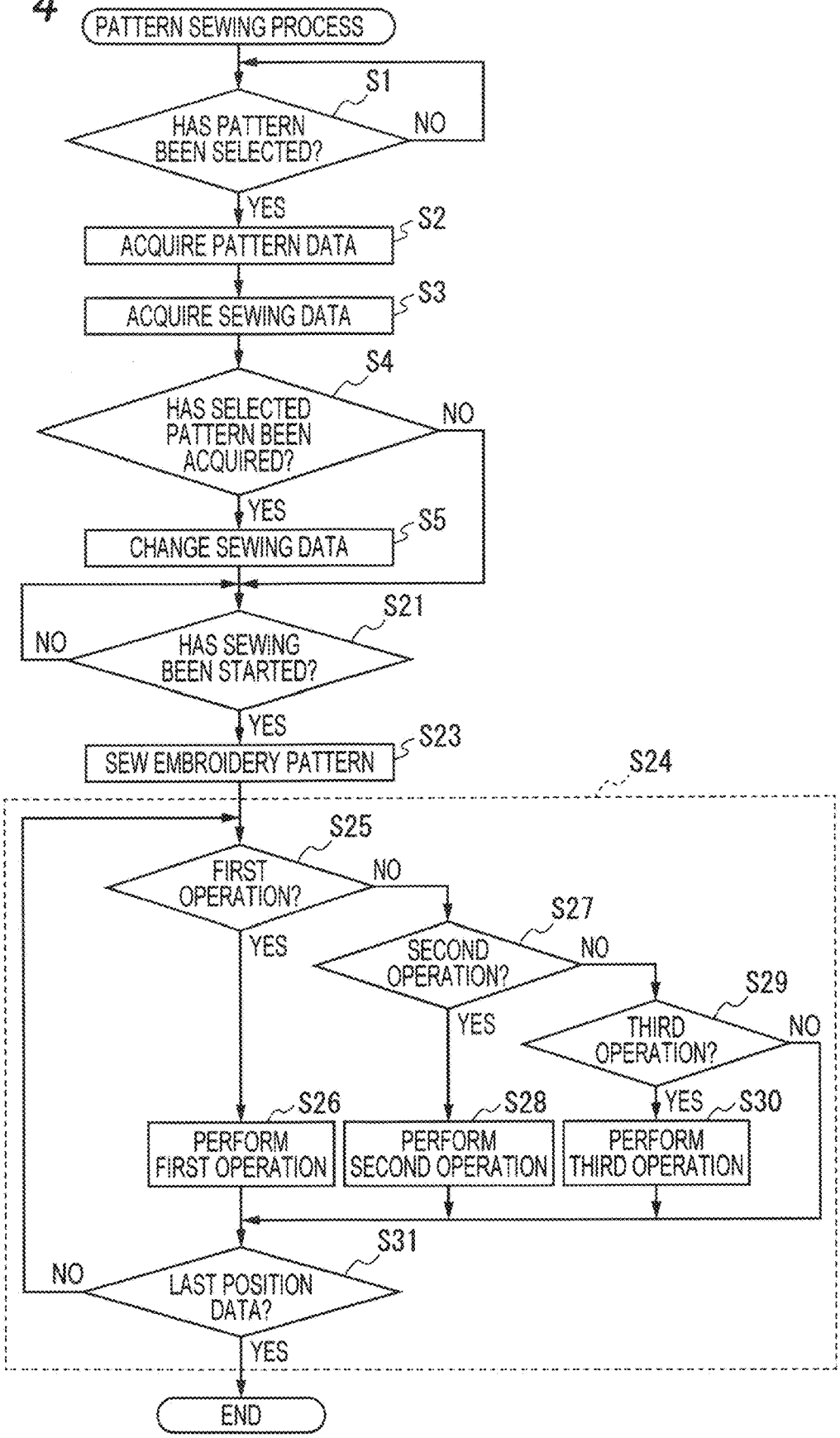
FIG. 4 is a flowchart of a pattern sewing process.
Figure 5A:
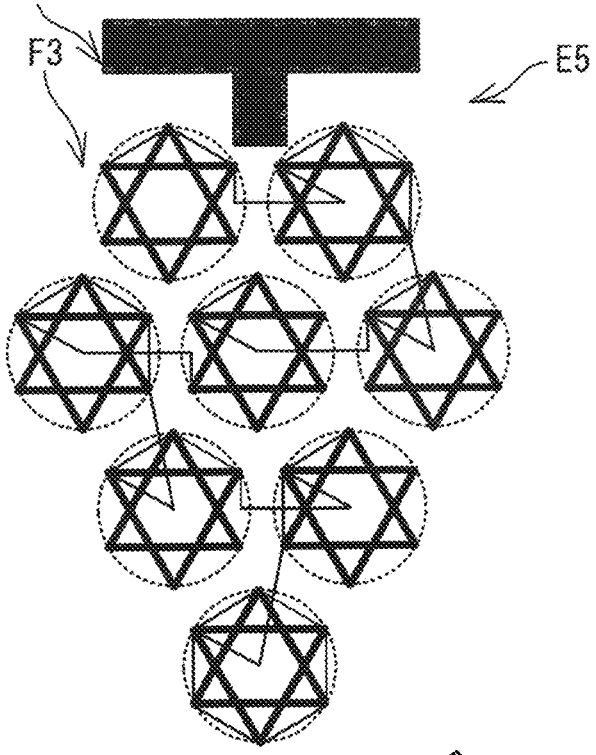
FIG. 5A illustrates a pattern E5 in which an embroidery pattern E3 and eight first unit patterns F3 are combined.

Referring to FIGS. 4 and 5A to 5C, a pattern sewing process performed by the sewing machine 1 will be described with reference to a case where a pattern E5 shown in FIG. 5A is sewn. When sewing a pattern including an embroidery pattern and a unit pattern, the user operates the operation interface 29 to input an instruction to start the pattern sewing process. The CPU 7 detects an instruction to start the pattern sewing process based on a signal output from the operation interface 29.

In response to detecting an instruction to start the pattern sewing process, the CPU 7 reads a program for performing the pattern sewing process stored in the memory 24 into the RAM 23. The program includes instructions for causing the CPU 7 to perform the following processes. The CPU 7 performs the following steps in accordance with instructions included in the program read out to the RAM 23. Hereinafter, the step is abbreviated as S.

Figure 5B:
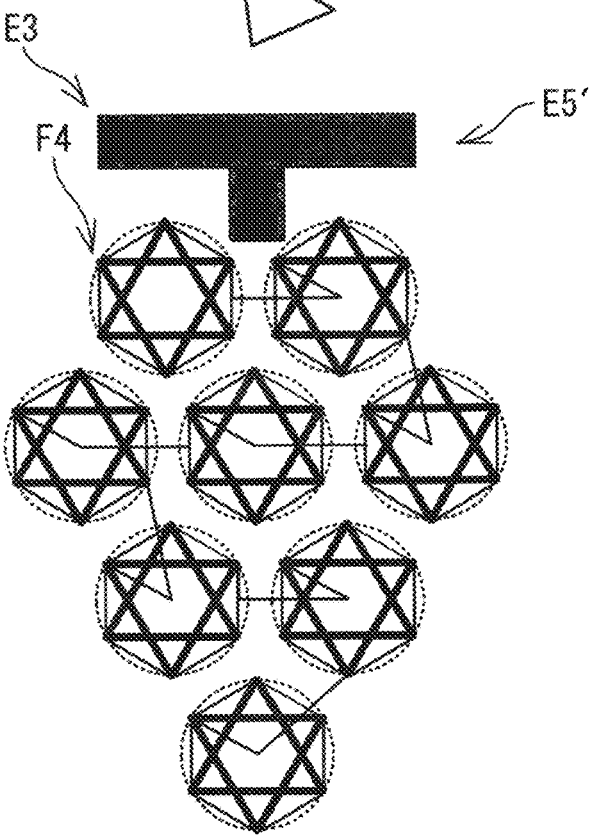
FIG. 5B illustrates a pattern E5' in which the embroidery pattern E3 and eight second unit patterns F4 are combined.
Figure 5C:
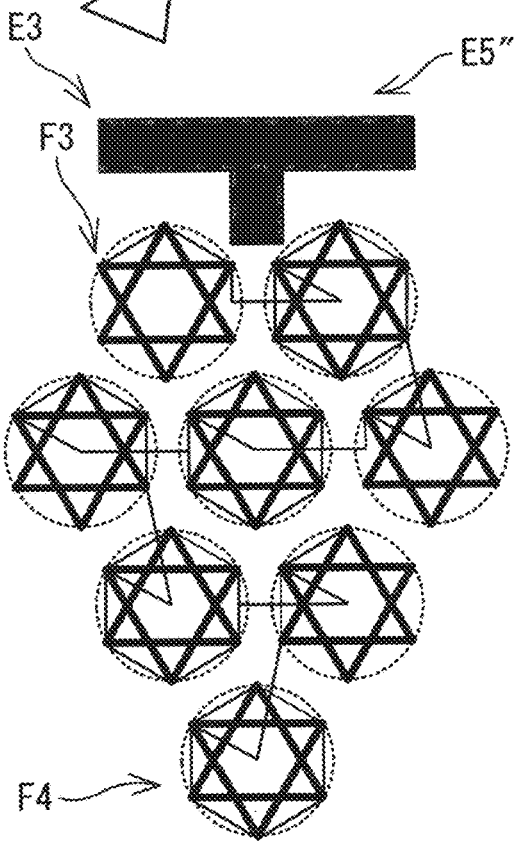
FIG. 5C illustrates a pattern E5" in which the embroidery pattern E3, four first unit patterns F3, and four second unit patterns F4 are combined.

The pattern E5 shown in FIGS. 5A, 5B and 5C is one of the patterns stored in the memory 24 and represents a pattern of a bunch of grapes as a whole. The pattern E5 is a combination of an embroidery pattern E3 and eight first unit patterns F3. The embroidery pattern E3 is a pattern of a T-shaped stem sewn with a single color thread. The eight first unit patterns F3 are patterns indicating grapes and are sewn at positions not overlapping the embroidery pattern E3.

In FIG. 5A, the first unit pattern F3 disposed at the upper left among the eight first unit patterns F3 is the first unit pattern in the sewing order. The first unit pattern F3 disposed at the bottom is the last unit pattern in the sewing order. Needle drop points for sewing a jump stitch are set appropriately in two adjacent first unit patterns F3 which are sewn consecutively in the sewing order.

As shown in FIG. 4, the CPU 7 determines whether selection of a pattern is detected based on the signal output from the operation interface 29 (S1). The CPU 7 displays pattern candidates stored in the memory 24 on the display 28 and accepts the selection of a pattern. The user operates the operation interface 29 to select a pattern from the pattern candidates displayed on the display 28. When the user selects the pattern E5 by operating the operation interface 29, the operation interface 29 outputs a signal indicating that the pattern E5 is selected to the CPU 7.

When the selection of a pattern is not detected (S1: NO), the CPU 7 returns the processing to S1. When the selection of the pattern E5 is detected (S1: YES), the CPU 7 acquires pattern data for sewing the embroidery pattern E3 included in the pattern E5 from the memory 24 (S2). The CPU 7 acquires sewing data for sewing the eight first unit patterns F3 included in the pattern E5 from the memory 24 (S3). The sewing data for sewing the eight first unit patterns F3 acquired in S3 is data for forming the stitches shown in FIG. 5A on the sewing workpiece C.

The CPU 7 determines whether a selected pattern has been acquired (S4). The selected pattern is a unit pattern of a type selected from the first unit pattern F3 and the second unit pattern F4. In this embodiment, the user selects the unit patterns included in the pattern E5 from among the first unit pattern F3, the second unit pattern F4, and a mixture of the first unit pattern F3 and the second unit pattern F4. The option of mixing the first unit pattern F3 and the second unit pattern F4 is selectable when a plurality of unit patterns are sewn.

The user selects the type of the unit pattern by operating the operation interface 29. In this embodiment, the unit pattern of the type selected by the user is referred to as a selected pattern. When the user selects the type of the unit pattern by operating the operation interface 29, the operation interface 29 outputs a selection result to the CPU 7. The CPU 7 acquires the selected pattern in accordance with the selection result output from the operation interface 29. That is, the CPU 7 identifies the unit pattern of the type selected by the user as the selected pattern.

When the selected pattern is acquired (S4: YES), the CPU 7 changes the sewing data acquired in S3 in accordance with the acquired selected pattern (S5). When the first unit pattern F3 is acquired as the selected pattern, the CPU 7 does not change the sewing data acquired in S3. When the second unit pattern F4 is acquired as the selected pattern, the CPU 7 changes the sewing data acquired in S3 to sewing data for forming stitches of the second unit pattern F4 so as to obtain a pattern E5' shown in FIG. 5B. That is, the sewing data E1 for sewing the first unit pattern F3 is changed to the sewing data E2 for sewing the second unit pattern F4.

When the option of mixing the first unit pattern F3 and the second unit pattern F4 is acquired as the selected pattern in S4, the CPU 7 changes a part of the sewing data acquired in S3 to sewing data for forming stitches of the second unit pattern F4 so as to obtain a pattern E5" shown in FIG. 5C. That is, the sewing data is changed from the sewing data E1 to mixed data of the sewing data E1 and the sewing data E2. In the example shown in FIG. 5C, the first unit pattern F3 and the second unit pattern F4 are alternately arranged in the sewing order. In FIG. 5C, the first unit pattern F3 disposed at the upper left among the plurality of unit patterns is the first unit pattern in the sewing order. The second unit pattern F4 disposed at the bottom is the last unit pattern in the sewing order.

When the selected pattern is not acquired (S4: NO), or after S5, the CPU 7 determines whether an instruction to start sewing has been detected (S21). The user holds the sewing workpiece C on the embroidery frame 17 and attaches the embroidery frame 17 to the holder 37. The user sets a thread of the first color in the sewing order, which is used for sewing an embroidery pattern, on the sewing machine 1. The user operates the start-stop switch 30 to input an instruction to start sewing.

When the start-stop switch 30 is operated and a signal indicating that the start-stop switch 30 has been pressed is input, the CPU 7 determines that an instruction to start sewing has been detected. The CPU 7 waits in S21 until a sewing start instruction is detected (S21: NO). When the sewing start instruction is detected (S21: YES), the CPU 7 controls the needle bar 8 and the carriage 19 in accordance with the pattern data to perform an embroidery pattern sewing operation for sewing an embroidery pattern (S23). When the embroidery pattern and the unit pattern are sewn, the CPU 7 of the present embodiment performs the embroidery pattern sewing operation and then performs a unit pattern sewing operation for sewing the unit pattern. In the embroidery pattern sewing operation, a T-shaped embroidery pattern E3 indicated by stitches of the satin stitching is sewn.

The CPU 7 controls the needle bar 8 and the carriage 19 based on the sewing data to perform the unit pattern sewing operation of sewing a unit pattern on the sewing workpiece C (S24). The CPU 7 performs a first operation of sewing the first polygon F1 based on the first data D1 a first number of times in the unit pattern sewing operation. The CPU 7 performs a second operation of sewing the second polygon F2 based on the second data D2 a second number of times in the unit pattern sewing operation. When the selected pattern is acquired in S4, the CPU 7 performs the unit pattern sewing operation to sew the selected pattern in accordance with the sewing data.

The CPU 7 determines whether the first operation is to be performed (S25). The CPU 7 reads out, in the sewing order, the position data included in the sewing data acquired in S3 and changed in S5. When the read position data is the position data included in the first data D1, the CPU 7 determines to perform the first operation. Whether the read position data is the position data included in the first data D1 may be determined based on the value of the position data or based on the sewing order. A flag indicating that the sewing data is the first data D1 may be provided. In this case, the CPU 7 may determine whether the read position data is data included in the first data D1 based on the flag.

When the first operation is to be performed (S25: YES), the CPU 7 reads out the position data D3 of the first data D1 in the sewing order. The CPU 7 controls the needle bar 8 and the carriage 19 to perform the first operation of sewing the first polygon F1 on the sewing workpiece C (S26). The sewing needle 6 is inserted into the needle drop points in order to form stitches. In this way, the CPU 7 sews the first polygon F1 on the sewing workpiece C. At the beginning of sewing, in order to prevent thread slippage, a needle drop point may be added between the first vertex P1 of the sewing order "1" and the first vertex P2 of the sewing order "2" and sewing may be performed. At the beginning of sewing, a reverse stitch may be performed to prevent thread slippage.

The CPU 7 determines whether the current position data is the last position data included in the sewing data (S31). The current position is the position used by the CPU 7 to insert the sewing needle 6 into the needle drop point immediately before the processing of S31. The CPU 7 reads out, in the sewing order, the position data included in the sewing data acquired in S3 and changed in S5, and determines that the position data is the last position data when no subsequent position data exists in the sewing order. When the current position data is not the last position data (S31: NO), the CPU 7 reads the position data of the next sewing order, and returns the processing to S25.

When the first operation is not to be performed (S25: NO), the CPU 7 determines whether the second operation is to be performed (S27). The CPU 7 reads out, in the sewing order, the position data included in the sewing data acquired in S3 and changed in S5. When the read position data is the position data included in the second data D2, the CPU 7 determines that the second operation is to be performed. The method of determining whether the read position data is the position data included in the second data D2 may be the same as the method of determining whether the read position data is the position data included in the first data D1, for example.

When the second operation is to be performed (S27: YES), the CPU 7 reads out the position data D3 of the second data D2 in the sewing order. The CPU 7 controls the needle bar 8 and the carriage 19 to perform the second operation of sewing the second polygon F2 on the sewing workpiece C (S28). The sewing needle 6 is inserted into the needle drop points in order to form stitches. In this way, the CPU 7 sews the second polygon F2 on the sewing workpiece C. After S28, the CPU 7 performs the processing of S31.

When the second operation is not to be performed (S27: NO), the CPU 7 determines whether the third process is to be performed (S29). The CPU 7 determines that the third process is to be performed when the current position data is the position data D3 of the needle drop point for sewing the jump stitch. When the third process is to be performed (S29: YES), the CPU 7 reads out the position data D3 of the needle drop point for sewing the jump stitch in the sewing order. The CPU 7 controls the needle bar 8 and the carriage 19 to perform the third process of sewing the jump stitch on the sewing workpiece C (S30). The sewing needle 6 is inserted into the needle drop points in order to form stitches. In this way, the CPU 7 sews the jump stitch on the sewing workpiece C. When the third process is not to be performed (S29: NO), or after S30, the CPU 7 performs the processing of S31.

In the present embodiment, when sewing the first unit pattern F3, the CPU 7 performs the first operation five times consecutively based on the five consecutive first data D1 in the unit pattern sewing operation (S26). Thereafter, the CPU 7 performs the second operation five times consecutively based on the five consecutive second data D2 (S28).

In the present embodiment, when sewing the second unit pattern F4, the CPU 7 consecutively performs the first operation three times based on three consecutive first data D1 (S26). Thereafter, the CPU 7 performs the second operation three times consecutively based on the three consecutive second data D2 (S28). Thereafter, the CPU 7 alternately repeats the first operation and the second operation twice. When the position data currently being read out is the last data (S31: YES), the CPU 7 ends the pattern sewing process.

Figure 6:
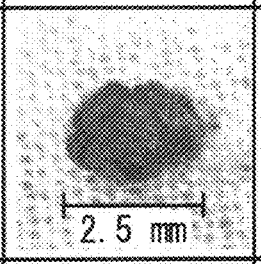
FIG. 6 illustrates a photo image of a sewn product having stitches expressing a French knot stitch in first to fifth conditions by the embroidery sewing machine 1.
Figure 6:
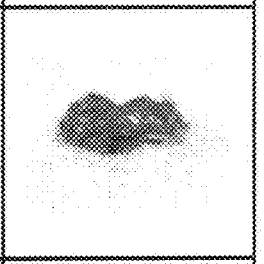
Figure 6:
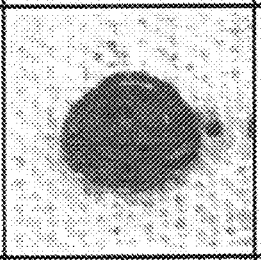
Figure 6:
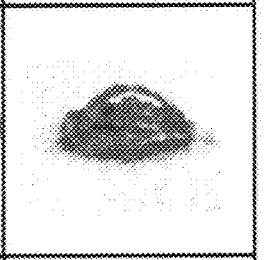
Figure 6:
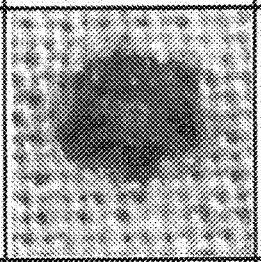
Figure 6:
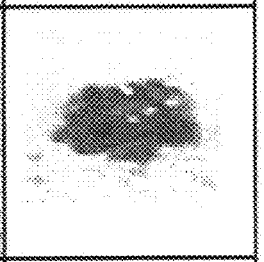
Figure 6:
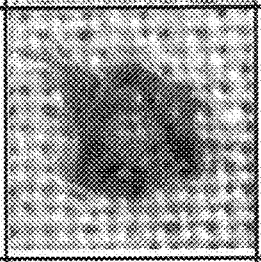
Figure 6:
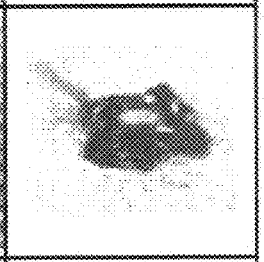
Figure 6:
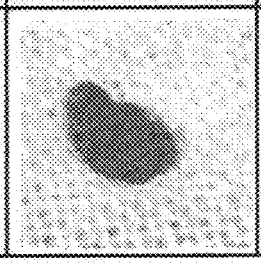
Figure 6:
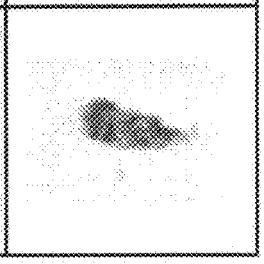

FIG. 6 shows evaluation results of reproducibility of three-dimensional roundness of the French knot stitching for each of stitches in first to fifth conditions. As shown in FIG. 6, the stitches in the first condition were the stitches of the first unit pattern F3 in which the first number of times and the second number of times were both five. The stitches in the first condition were stitches based on the sewing data E1 of the present embodiment. The stitches in the second condition were the stitches of the second unit pattern F4 in which the first number of times and the second number of times were both five. The stitches in the second condition were stitches based on the sewing data E2 of the present embodiment.

The stitches in the third condition were the stitches of the first unit pattern F3 in which the first number of times and the second number of times were both two. The stitches in the third condition were the stitches of the first unit pattern F3 that was sewn by performing the first operation twice consecutively and then performing the second operation twice consecutively. That is, the first number of times and the second number of times in the third condition were smaller than those in the first condition.

The stitches in the fourth condition were the stitches of the second unit pattern F4 in which the first number of times and the second number of times are both two. The stitches in the fourth condition were the stitches of the second unit pattern F4 in a case where the first operation and the second operation were alternately repeated twice. That is, the first number of times and the second number of times in the fourth condition were smaller than those in the second condition. The stitches in the fifth condition were the stitches of the zigzag sewing formed by a known method using the sewing machine 1. That is, the stitches in the fifth condition were formed by zigzag sewing so as to fill a circular region.

The diameter of the virtual ring C1 in the first to fifth conditions was set to 2.5 mm. The upper thread and the lower thread were those for embroidery sewing machines. The sewing workpiece C was a plain-woven fabric. The sewn product was placed on a horizontal desk, and a photo image of the stitch under each condition captured from obliquely above and a photo image captured from the side were obtained.

As shown in FIG. 6, the stitches in the first to fourth conditions are stitches in which two polygons, particularly two regular triangles, overlap. On the other hand, the stitches in the fifth condition are formed by zigzag sewing so as to fill a circular region, and the stitches are crushed. Thus, it was confirmed that the stitches in the first to fourth conditions were all able to express a three-dimensional roundness as compared with the stitches in the zigzag sewing in the fifth condition, and the reproducibility of the French knot stitching was improved.

The number of overlapping polygons in the stitches in the first condition is larger than that in the stitches in the third condition. Thus, the stitches of the first unit pattern F3 in the first condition express a three-dimensional feeling of the stitches better than the stitches of the first unit pattern F3 in the third condition. The number of overlapping polygons in the stitches in the second condition is larger than that in the stitches in the fourth condition. Thus, the stitches of the second unit pattern F4 in the second condition express the three-dimensional feeling of the stitches better than the stitches of the second unit pattern F4 in the fourth condition. From this, it was confirmed that it is better that the first number of times and the second number of times are five times rather than twice.

The stitches of the first unit pattern F3 in the first condition is compared with the stitches of the second unit pattern F4 in the second condition. In the stitches of the second unit pattern F4, the first operation and the second operation were performed alternately and repeatedly a plurality of times, and thus the stitches were arranged in an intertwined manner and a fine three-dimensional effect was exhibited. On the other hand, the stitches of the first unit pattern F3 were arranged in an orderly manner and had a luster like satin. From the above, it was confirmed that, by changing the order of performing the first operation and the second operation, stitches having different appearances are formed even in the unit pattern in which the same first polygon F1 and second polygon F2 are combined.

As described above, it was confirmed that the first to fourth conditions are superior to the fifth condition in terms of expressing the three-dimensional feeling and roundness of the stitch. It was confirmed that the first and second conditions were superior to the third and fourth conditions in terms of expressing the three-dimensional feeling of the stitches. It was confirmed that neither the first condition nor the second condition is superior to the other in the three-dimensional feeling and roundness of the stitches, but the stitches having different appearances are formed.

In the stitches of the unit pattern of the present embodiment, a first triangle which is a regular triangle and a second triangle which is obtained by rotating the first triangle by 180 degrees overlap each other. Thus, in the unit pattern of the present embodiment, one side of the first triangle and two sides of the second triangle overlap each other, and a three-dimensional effect is expressed. The stitches of the unit pattern of the present embodiment express a round shape because the vertices of the two triangles are located on the same circumference. Since the first number of stitches and the second number of stitches are five, the unit pattern of the present embodiment expresses a three-dimensional effect more than the case where the first number of stitches and the second number of stitches are two.

In the stitches of the unit pattern of this embodiment, a regular hexagonal shape having the center C2 as the center is formed at a position close to the center C2 inside the virtual ring C1. If the polygon formed inside the virtual ring C1 is formed at a position far from the center C2, the stitches of the unit pattern may be formed in a shape in which the center is recessed. In the stitches of the unit pattern of this embodiment, since the polygon formed inside the virtual ring C1 is formed at a position close to the center C2, a dome-shaped three-dimensional roundness is expressed in a side view.

The first unit pattern F3 has the stitches arranged in an orderly manner, and expresses a luster like satin. Thus, the first unit pattern F3 is suitable for sewing a pattern requiring a glossy feeling, such as a fruit pattern. The second unit pattern F4 is arranged with the stitches intertwined, and expresses a detailed three-dimensional feeling. Thus, the second unit pattern F4 is suitable for sewing a pattern requiring fineness, such as a pattern of hair of an animal such as sheep.

In the present embodiment, a unit pattern is selected from the first unit pattern F3 and the second unit pattern F4. The user selects the type of unit pattern in accordance with the pattern he or she wishes to express. In the above embodiment, when a plurality of unit patterns are sewn, the user may select an option including each of the first unit pattern F3 and the second unit pattern F4. Thus, the sewing machine 1 expresses the appearance close to that of the hand-sewing by utilizing difference in appearance of the unit patterns.

Figure 7:
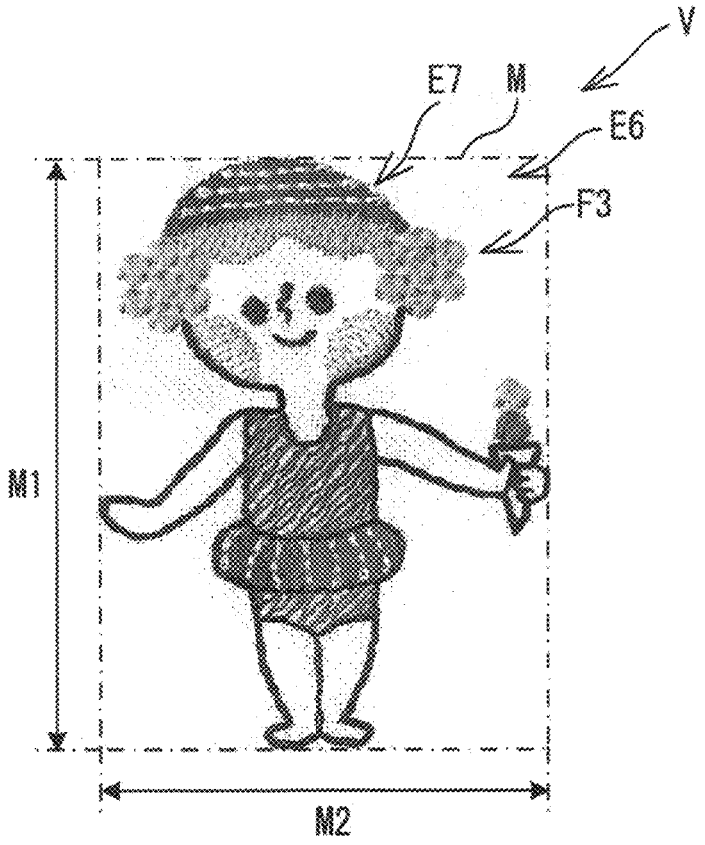
FIG. 7 is a photo image of a pattern E6 including an embroidery pattern E7 showing a blond girl and the first unit pattern F3 showing a girl's curly hair.

Referring to FIG. 7, a sewn product V having a pattern E6 and sewn in accordance with the pattern sewing process of the above embodiment was evaluated. The pattern E6 includes an embroidery pattern E7 and a plurality of first unit patterns F3. The embroidery pattern E7 shows a blond girl wearing a swimming cap, a rubber swimming ring and a bathing suit, holding an ice cream cone. The eyes, cheeks, swimming cap, swimming ring and part of the hair of the girl were sewn with satin or tatami stitches, which are stitches in a uniform direction set for each. The body and face of the girl were sewn with linear stitches representing the contours. In the region surrounded by the contour, neither the satin stitch nor the tatami stitch was formed. The plurality of first unit patterns F3 showed curled portions of a girl's hair and ice cream on a cone. A height M1 of a minimum rectangle M including the pattern E6 in the vertical direction in FIG. 7 was set to 56.6 mm. A width M2 of the minimum rectangle M in the lateral direction in FIG. 7 was set to 42.9 mm.

As shown in FIG. 7, the eyes of the girl are shown with the satin stitches arranged in a circular region slightly smaller than the virtual ring C1 of the first unit pattern F3. That is, the girl's eye area is shown with stitches close to the known French knot stitch. It was confirmed that the curly part of the girl's hair sewn with the first unit pattern F3 and the ice cream on the cone have a more rounded three-dimensional feeling than the girl's eyes. From the photo image of the pattern E6, it was confirmed that a rounded three-dimensional effect which cannot be expressed by stitches such as satin stitch and tatami stitch is expressed by representing a part of the pattern E6 by a plurality of first unit patterns F3. It was confirmed that the sewing machine 1 is capable of sewing a combination of the embroidery pattern E7 and the first unit pattern F3 in the pattern E6, and thus contributes to a wider variety of expression of the patterns that are sewable by the sewing machine 1.

In the above embodiment, the sewing machine 1 is an example of a sewing machine of the present disclosure. The needle bar 8 is an example of a needle bar of the present disclosure. The carriage 19 is an example of a carriage of the present disclosure. The memory 24 is an example of a memory of the present disclosure. The CPU 7 is an example of a controller (processor) of the present disclosure.

The processing in S3 is an example of a sewing data acquisition operation of the present disclosure. The processing in S24 is an example of a unit pattern sewing operation of the present disclosure. The processing in S26 is an example of a first operation of the present disclosure. The processing in S28 is an example of a second operation of the present disclosure. The processing in S4 is an example of a selected pattern acquisition operation of the present disclosure. The processing in S23 is an example of an embroidery pattern sewing operation of the present disclosure. The processing in S2 is an example of a pattern data acquisition operation of the present disclosure.

The sewing machine 1 of the above embodiment includes the needle bar 8, the carriage 19, the memory 24, and the CPU 7. The carriage 19 is capable of holding the embroidery frame 17 and moves the embroidery frame 17 relative to the needle bar 8. The memory 24 stores sewing data for sewing a unit pattern in which the first polygon F1 and the second polygon F2 are overlapped on the sewing workpiece C held on the embroidery frame 17. The sewing data includes the first data D1 and the second data D2. The first data D1 is data for sewing the first polygon F1. The second data D2 is data for sewing the second polygon F2. The second polygon F2 is a polygon obtained by rotating the first polygon F1 about the center C2 of the virtual ring C1 circumscribed about the first polygon F1. The CPU 7 is configured to perform the sewing data acquisition operation for acquiring sewing data from the memory 24 (S3). The CPU 7 controls the needle bar 8 and the carriage 19 based on the sewing data to perform the unit pattern sewing operation for sewing a unit pattern on the sewing workpiece C (S24). The CPU 7 performs the first operation (S25) of sewing the first polygon F1 based on the first data D1 a first number of times, which is two or more times, in the unit pattern sewing operation. In the unit pattern sewing operation, the CPU 7 performs the second operation (S27) of sewing the second polygon F2 based on the second data D2 a second number of times, which is two or more times. The first polygon F1 and the second polygon F2 are inscribed in the same virtual ring C1. The second polygon F2 has a side intersecting two sides extending from a vertex of the first polygon F1.

The sewing machine 1 sews the first polygon F1 two or more times in the unit pattern sewing operation. The sewing machine 1 sews the second polygon F2, which is obtained by rotating the first polygon F1, two or more times in an overlapping manner with the first polygon F1. The sewing machine 1 performs sewing in the unit pattern sewing operation such that the first polygon F1 and the second polygon F2 are inscribed in the same virtual ring C1. The second polygon F2 has a side intersecting two sides extending from a vertex of the first polygon F1. The unit pattern sewing operation of the sewing machine 1 contributes to improving the reproducibility in a case where a hand-sewn French knot stitch is expressed with a roundness with a three-dimensional feeling by the sewing machine 1. When the sewing machine 1 consecutively sews each of the first polygon F1 and the second polygon F2, no jump stitch is needed and no thread needs to be cut in the middle. Thus, the unit pattern sewing operation of the sewing machine 1 contributes to facilitating the process of sewing the unit pattern by the sewing machine 1.

In the unit pattern sewing operation, the CPU 7 consecutively performs the first operation a first number of times and then consecutively performs the second operation a second number of times. The unit pattern sewing operation of the sewing machine 1 contributes to relatively shortening the time for performing the first operation of the first number of times and the second operation of the second number of times. The unit pattern sewing operation of the sewing machine 1 contributes to sewing a unit pattern having a satin like luster with the stitches arranged in an orderly manner.

The CPU 7 alternately repeats the first operation and the second operation a plurality of times in the unit pattern sewing operation. In the unit pattern sewing operation of the sewing machine 1, the first operation and the second operation are alternately repeated a plurality of times, whereby the stitches are arranged in an intertwined manner. Thus, the unit pattern sewing operation of the sewing machine 1 contributes to forming a unit pattern in which stitches are arranged in an intertwined manner and a fine three-dimensional feeling is expressed.

The memory 24 stores pattern data for sewing an embroidery pattern including a pattern indicated by stitches in a uniform direction on the sewing workpiece C. The embroidery pattern is a pattern different from the unit pattern. The CPU 7 performs the pattern data acquisition operation for acquiring pattern data from the memory 24 and the embroidery pattern sewing operation for sewing an embroidery pattern in accordance with the pattern data. When the embroidery pattern and the unit pattern are sewn, the CPU 7 performs the embroidery pattern sewing operation and then performs the unit pattern sewing operation.

A pattern which combines an embroidery pattern and a unit pattern may be sewn in order to express various designs. If the unit pattern is sewn before the embroidery pattern, a part of the unit pattern is covered with the embroidery pattern, and a three-dimensional roundness may be lost. The embroidery pattern sewing operation of the sewing machine 1 contributes to avoiding the unit pattern from being covered with the embroidery pattern.

The types of unit patterns include the first type and the second type. The first unit pattern F3, which is the first-type unit pattern, is sewn by consecutively performing the first operation a first number of times and then consecutively performing the second operation a second number of times. The second unit pattern F4, which is the second-type unit pattern, is sewn by alternately performing the first operation and the second operation a plurality of times. The CPU 7 performs the unit pattern sewing operation to sew the first unit pattern F3 and the second unit pattern F4.

The unit pattern sewing operation of the sewing machine 1 contributes to making the sewing finish different between the first unit pattern F3 and the second unit pattern F4. The unit pattern sewing operation of the sewing machine 1 contributes to sewing unit patterns having various expressions, compared with the case where all the unit patterns are shown by the same stitch.

The types of unit patterns include the first type and the second type. The first unit pattern, which is the first-type unit pattern, is sewn by consecutively performing the first operation a first number of times and then consecutively performing the second operation a second number of times. The second unit pattern F4, which is the second-type unit pattern, is sewn by alternately performing the first operation and the second operation a plurality of times. The CPU 7 is configured to perform the selected pattern acquisition operation for acquiring a selected pattern which is a unit pattern of a type selected from the first unit pattern F3 and the second unit pattern F4 (S4). The CPU 7 performs the unit pattern sewing operation to sew the selected pattern. The unit pattern sewing operation of the sewing machine 1 contributes to improving the convenience of the user in sewing the unit pattern, compared with the case where a pattern cannot be selected.

The sewing data is obtained by associating the position data with the sewing order indicating the order of piercing the sewing workpiece C with the sewing needle 6 at the needle drop point. The position data indicates the position of the needle drop point. The needle drop point is a point where the needle bar 8 of the sewing machine 1 is lowered and the sewing workpiece C is pierced with the sewing needle 6 attached to the needle bar 8. The sewing data includes two or more (first number of) first data D1 and two or more (second number of) second data D2. The first data D1 is position data indicating, in the sewing order, the positions of the first vertices, which are the plurality of vertices of the first polygon F1, of the unit pattern obtained by overlapping the first polygon F1 and the second polygon F2. The second data D2 is position data indicating, in the sewing order, the positions of the second vertices, which are the plurality of vertices of the second polygon F2. The second polygon F2 is a polygon obtained by rotating the first polygon F1 about the center C2 of the virtual ring C1 circumscribed about the first polygon F1. The shape of the second polygon F2 is the same as that of the first polygon F1. The first polygon F1 and the second polygon F2 are inscribed in the same virtual ring C1.

When the sewing data is used for sewing a unit pattern by the sewing machine 1, the following effects are achieved. That is, the sewing data contributes to sewing a unit pattern expressing a three-dimensional roundness of the hand-sewn French knot stitch by overlapping the first polygon F1 and the second polygon F2. The first polygon F1 and the second polygon F2 are inscribed in the same circle, thereby contributing to sewing a unit pattern expressing the roundness of the French knot stitch. The sewing data contributes to improvement in reproducibility in a case where the French knot stitch is expressed by the sewing machine 1.

The first polygon F1 is a first triangle having three first vertices. The second polygon F2 is a second triangle having three second vertices. Since the sewing data of the first polygon F1 and the second polygon F2 are triangles having the simplest structure among the polygons, the sewing data contributes to smoothly sewing the unit pattern by the sewing machine 1.

The first triangle and the second triangle are regular triangles having sides of the same length. The virtual ring C1 circumscribed about the first triangle and the second triangle is a virtual circle. When the sewing data is used for sewing a unit pattern by the sewing machine 1, the sewing data contributes to expressing the roundness of the hand-sewn French knot stitch. Under the condition that the diameters of the virtual rings C1 are the same, when the first polygon and the second polygon are regular triangles, the stitches are arranged closer to the center C2 of the virtual ring C1 than in a case of other regular polygons. In addition, the length of one side of a regular triangle is longer than the length of one side of another regular polygon, and the stitches are likely to be loose. Thus, when the sewing machine 1 uses the sewing data for sewing the unit pattern, the sewing data is likely to give a three-dimensional feeling to the stitches, and contributes to expressing the roundness of the hand-sewn French knot stitch.

The second triangle is a regular triangle obtained by rotating the first triangle by 180 degrees about the center C2 of the virtual ring C1 circumscribed about the first triangle as the rotation center. The sewing data contributes to maximizing the distance between the first vertex and the second vertex adjacent to each other on the virtual ring C1 under the condition that the first triangle and the second triangle are regular triangles. When the sewing data is used for sewing a unit pattern by the sewing machine 1, the following effects are achieved. That is, the sewing data contributes to reducing the possibility of occurrence of a problem such as the sewing needle 6 being caught in the already formed stitch or noise being generated due to the fact that the first vertex and the second vertex are set at relatively close positions.

The first polygon F1 and the second polygon F2 are regular polygons having sides of the same length. The virtual ring C1 circumscribed about the first polygon F1 and the second polygon F2 is a virtual circle. Thus, when the sewing data is used for sewing a unit pattern by the sewing machine 1, the following effects are achieved. That is, the sewing data contributes to expressing the roundness of the French knot stitching, compared with the case where the virtual ring C1 is a virtual ellipse.

The second polygon F2 is a polygon obtained by rotating the first polygon F1 by a particular angle with the center C2 of the virtual ring C1 as the rotation center. The particular angle is an angle at which one of the second vertices is located on the median of two adjacent vertices of the first vertices. When the sewing data is used for sewing a unit pattern by the sewing machine 1, the following effects are achieved. That is, the sewing data contributes to reducing the possibility of occurrence of a problem such as the sewing needle 6 being caught in the already formed stitch or noise being generated due to the fact that the first vertex and the second vertex are set at relatively close positions.

The first number and the second number are the same number. When the sewing data is used for sewing a unit pattern by the sewing machine 1, the following effects are achieved. That is, the sewing data contributes to reducing a partial height difference in the unit pattern, as compared with the case where the first number and the second number are different from each other.

Each of the first number and the second number is a number of five or less. When the sewing data is used for sewing a unit pattern by the sewing machine 1, the following effects are achieved. That is, the sewing data contributes to reducing the possibility that the sewing needle 6 is caught in the already formed stitch, as compared with the case where each of the first number and the second number is larger than five.

The first number and the second number are five. When the sewing data is used for sewing a unit pattern by the sewing machine 1, the following effects are achieved. That is, the sewing data contributes to reducing the possibility that the sewing needle 6 is caught in the already formed stitch and to sewing the unit pattern having a three-dimensional roundness, as compared with the case where the first number and the second number are other than five.

The sewn product W having stitches of a thread for a sewing machine is provided with a plurality of stitches H1 which connect five or more needle drop points located on the virtual ring C1. Among five or more needle drop points, a first needle drop point, a second needle drop point arranged next to the first needle drop point, and a third needle drop point arranged next to the second needle drop point and different from the first needle drop point are defined. In this case, the plurality of stitches H1 include two or more stitches connecting the first needle drop point and the third needle drop point. Thus, the sewn product W uses a thread for a sewing machine and has stitches having a round shape with a three-dimensional feeling, thereby contributing to improving the reproducibility of the hand-sewn French knot stitch.

The number of stitches connecting the first needle drop point and the second needle drop point is smaller than the number of stitches connecting the first needle drop point and the third needle drop point. The sewn product W contributes to making the side shape of the stitches of the unit pattern into a dome shape, compared with the case where the number of stitches connecting the first needle drop point and the second needle drop point is larger than or equal to the number of stitches connecting the first needle drop point and the third needle drop point.

The sewn product W includes a stitch having the center C2 of the virtual ring C1 as one end. The sewn product W contributes to increasing the possibility that the sewn product W is covered with the stitch in the vicinity of the center C2 of the virtual ring C1. The sewn product W contributes to neatly arranging the path of the thread when sewing a jump stitch connecting unit patterns.

A fourth needle drop point is defined as a needle drop point which is located next to the third needle drop point and is different from the second needle drop point among five or more needle drop points located on the virtual ring C1. In this case, the sewn product W does not have a stitch connecting the first needle drop point and the fourth needle drop point. The sewn product W has a portion where the thread density near the center C2 of the virtual ring C1 is lower than the thread density around the center C2. Thus, the sewn product W expresses a three-dimensional feeling of the hand-sewn French knot stitch with stitches having a soft three-dimensional feeling of a roundness like a thread wound around the sewing needle 6.

The plurality of stitches H1 are stitches formed by intertwining the upper thread U1 and the lower thread U2 different from the upper thread U1. The sewn product W contributes to improving the reproducibility of the hand-sewn French knot stitching by the upper thread U1 and the lower thread U2.

While the disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

The sewing machine, the sewing data, and the sewn product of the present disclosure are not limited to the above-described embodiment, and various changes may be made. For example, the following modifications may be appropriately made. The present disclosure may be implemented in a variety of ways, such as in a non-transitory computer-readable storage medium storing sewing data and a sewing method performed by a processor of a sewing machine.

(A) The configuration of the sewing machine 1 may be changed as appropriate. The sewing machine 1 may be an industrial sewing machine or a multi-needle sewing machine having a plurality of needle bars as long as the sewing machine is capable of embroidery sewing. When the sewing machine 1 is a multi-needle sewing machine, the number of needle bars is not particularly limited. The pattern data may be acquired from a device other than the sewing machine 1, for example, a PC or a server connected via a network, or may be generated by the sewing machine 1 based on image data obtained by reading illustrations, photo images, and so on, by a scanner.

The display 28 may be any device capable of displaying images. The display 28 may be, for example, an organic EL display, a plasma display, a plasma tube array display, or an electronic paper display using electrophoresis. The operation interface 29 may be a keyboard, a mouse, a switch, and/or a joystick, in addition to or instead of the touch screen. The sewing machine 1 may include a communication interface for communicating with another apparatus.

(B) The program including the instruction for performing the pattern sewing process of FIG. 4 may be stored in a storage device of each apparatus before the CPU 7 performs the corresponding program. Accordingly, the method of acquiring the program, the acquisition path, and the apparatus storing the program may be changed as appropriate. The program executed by each apparatus may be received from another apparatus via a cable or wireless communication and stored in a storage device. The other apparatus includes, for example, a PC and a server connected via a network.

(C) Each step of the pattern sewing process in FIG. 4 is not limited to the example performed by the CPU 7, and a part or the entirety of the process may be performed by another electronic device (for example, an ASIC). Each step of the pattern sewing process may be distributed by a plurality of electronic devices (for example, a plurality of CPUs). The order of the steps of the pattern sewing process may be changed, and steps may be omitted or added as appropriate. The following changes may be made to the pattern sewing process as appropriate.

The shape, size and arrangement of the unit pattern may be changed as appropriate. The sewing data of the unit pattern stored in the memory 24 may be one type or three or more types. The memory 24 may store the first data D1 and the second data D2 as sewing data. In this case, the CPU 7 may read out the first data D1 and the second data D2 in accordance with the number of times and the order of execution of the first operation and the second operation, and perform the unit pattern sewing operation.

The CPU 7 may receive a user's input of the number of times of execution and the execution order of the first operation and the second operation. The CPU 7 may automatically set the number of times of execution of the first operation and the second operation depending on the thickness and color of the needle thread of the sewing machine 1.

The virtual ring C1 may be a virtual ellipse. In this case, the virtual ellipse may be close to a circle. The ratio of the major axis to the minor axis of the ellipse may be within the range of 0.7 to 1.3, for example.

The position of the needle drop point specified by the stitch of the sewn product W is affected by the expansion and contraction of the sewn product. For example, even when the needle drop point is ideally formed at the same position indicated by the sewing data by performing the first operation a first number of times, the needle drop point may be formed at a deviated position on the sewing workpiece due to the influence of the expansion and contraction of the sewing workpiece. Thus, the needle drop point of the sewing workpiece may not be disposed strictly on the virtual ring, and may be disposed at a position deviated from the point on the virtual ring by approximately 5% of the diameter of the virtual ring C1.

The position of the needle drop point is affected by the movement accuracy of the carriage 19. The size of the stitches of the unit pattern is relatively small, with the diameter of the virtual ring being approximately 1 to 5 mm. Thus, the first vertices of the first polygon and the second vertices of the second polygon may not be arranged strictly on the virtual ring. Thus, the sewing data may be arranged such that the needle drop points are located at positions deviated from the points on the virtual ring C1 by approximately 5% of the diameter of the virtual ring C1.

Figure 8A:
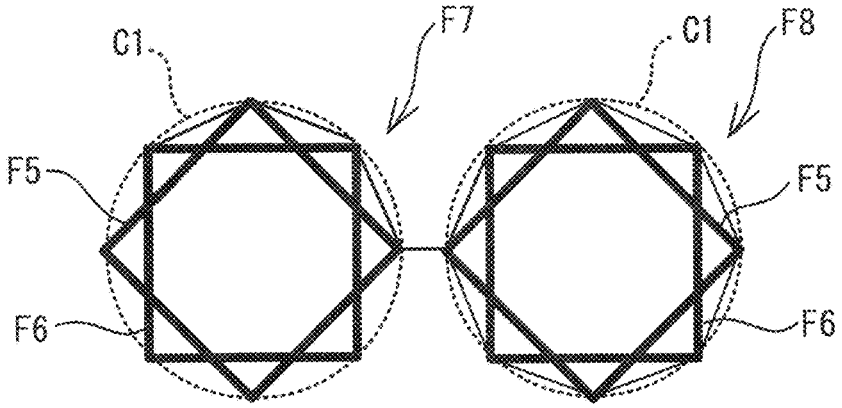
FIG. 8A illustrates a first unit pattern F7 and a second unit pattern F8.

The first polygon and the second polygon may be regular polygons having four or more vertices. As shown in FIG. 8A, a first polygon F5 and a second polygon F6 may be square. The sewing machine 1 may perform the first operation of sewing the first polygon F5 two or more times (first number of times) and the second operation of sewing the second polygon F6 two or more times (second number of times) to sew a first unit pattern F7. The sewing machine 1 may alternatively perform the first operation and the second operation a plurality of times to sew a second unit pattern F8. In the first unit pattern F7, a regular octagon is formed inside the virtual ring C1 by the sides of the first polygon F5 and the sides of the second polygon F6.

Figure 8B:
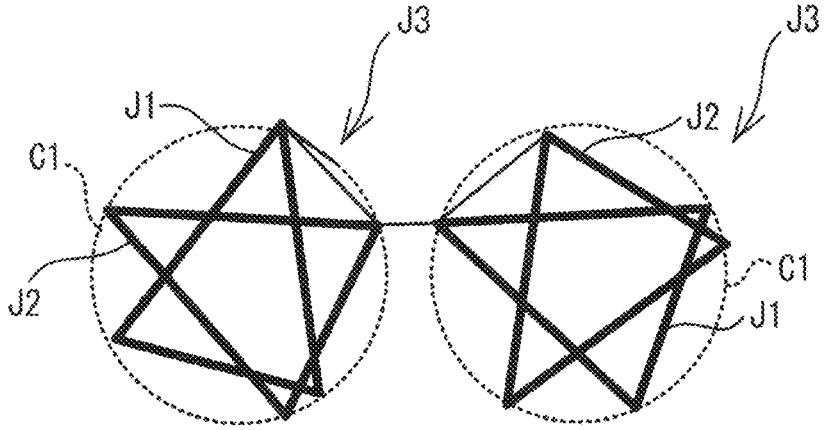
FIG. 8B illustrates two first unit patterns J3.

The first polygon and the second polygon may not be regular polygons. For example, as shown in FIG. 8B, a first polygon J1 and a second polygon J2 may be triangles other than regular triangles. The sewing machine 1 may perform the first operation of sewing the first polygon J1 two or more times (first number of times) and the second operation of sewing the second polygon J2 two or more times (second number of times) to sew a first unit pattern J3. In the first unit pattern J3, a hexagon which is not a regular hexagon is formed inside the virtual ring C1 by the sides of the first polygon J1 and the sides of the second polygon J2.

The sewn product may have a plurality of stitches formed by five or more needle drop points located on the virtual ring. Thus, the plurality of stitches of the sewing workpiece need not be stitches showing a unit pattern in which the first polygon and the second polygon are overlapped. The plurality of stitches of the sewn product may be, for example, a unit pattern J4 showing a star-shaped polygon having five needle drop points shown in FIG. 8C or a unit pattern J5 showing a star-shaped polygon having seven needle drop points. Since the star-shaped polygonal unit pattern having an odd number of needle drop points is expressed by so-called one stroke, the number of jump stitches is reduced as compared with a unit pattern in which a plurality of polygons are combined.

Figure 8C:
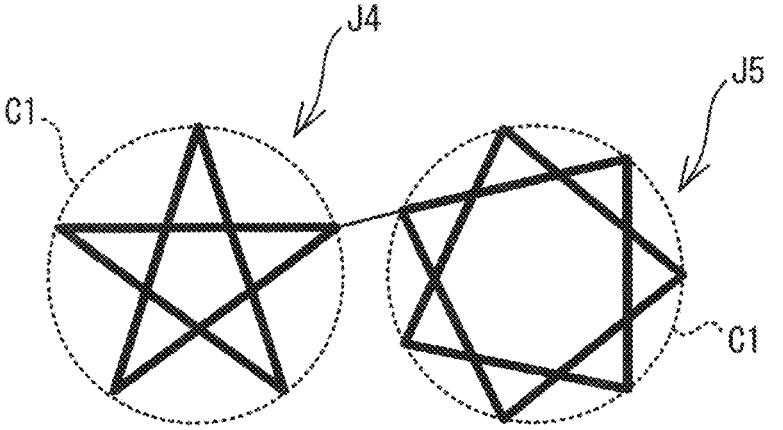
FIG. 8C illustrates a unit pattern J4 and a unit pattern J5.
Figure 8D:
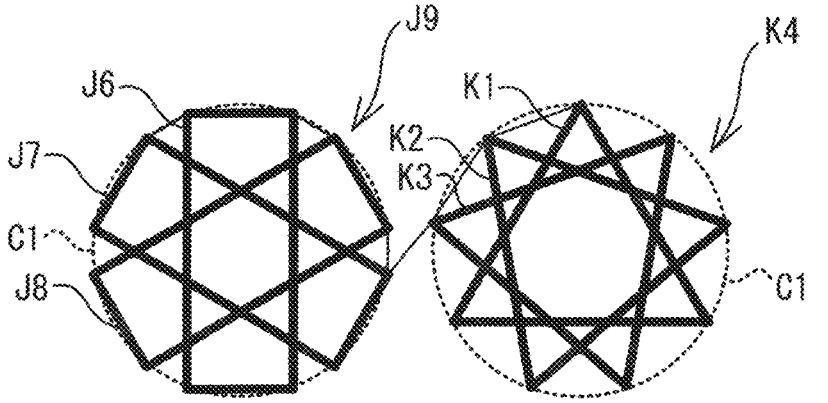
FIG. 8D illustrates a unit pattern J9 and a unit pattern K4.

The plurality of stitches of the sewn product may be stitches showing a unit pattern in which three or more polygons are overlapped. The plurality of stitches of the sewn product may be, for example, stitches formed by overlapping three rectangles J6, J7 and J8 as shown in FIG. 8D. The plurality of stitches of the sewn product may be stitches indicating a unit pattern K4 in which three regular triangles K1, K2 and K3 are overlapped.

The sewing data for sewing a plurality of unit patterns may be stored in the memory 24, may be acquired from an apparatus other than the sewing machine 1, for example, a PC and a server connected via a network, or may be generated at the time of sewing by connecting sewing data for sewing one unit pattern. The sewing data for sewing a plurality of unit patterns may be data for sewing a plurality of unit patterns arranged in the same direction. The sewing data for sewing a plurality of unit patterns may be data for sewing a plurality of unit patterns arranged in different directions as shown in FIG. 8B. The sewing data for sewing a plurality of unit patterns may be data for sewing a plurality of unit patterns having the same shape. The sewing data for sewing a plurality of unit patterns may be data for sewing a plurality of unit patterns having different shapes from each other as shown in FIGS. 8C and 8D.

When the embroidery pattern and the unit pattern are sewn, the CPU 7 may perform control to sew the embroidery pattern after the unit pattern or to sew the unit pattern during sewing the embroidery pattern. The embroidery pattern and the unit pattern may overlap each other. The embroidery may be satin and tatami stitches that are not stitches in a uniform direction.

The first number and the second number may be different from each other. The first number and the second number may be a plurality of numbers, and may be a number larger than five or a number smaller than five. The first number of times and the second number of times may be changed in a similar manner to the first number and the second number. Among five or more needle drop points located on the virtual ring, a first needle drop point, a second needle drop point arranged next to the first needle drop point, and a third needle drop point arranged next to the second needle drop point and different from the first needle drop point are defined. In this case, the number of stitches connecting the first needle drop point and the second needle drop point may be larger than or equal to the number of stitches connecting the first needle drop point and the third needle drop point. The plurality of stitches of the sewn product may not include a stitch having the center C2 of the virtual ring C1 as one end.

A fourth needle drop point is defined as a needle drop point which is located next to the third needle drop point and is different from the second needle drop point among five or more needle drop points located on the virtual ring. In this case, the sewn product may have a stitch connecting the first needle drop point and the fourth needle drop point.

The processing of S25, S27, and S29 may indicate that the sewing data is referred to. The processing of S25, S27, and S29 may be omitted. The sewing machine 1 may store sewing data in the memory 24 in S24, and perform sewing in accordance with the sewing data so that the unit pattern is sewn.

What is claimed is:

1. A sewing machine comprising:

a needle bar;

a carriage to which an embroidery frame is attachable, the carriage being configured to cause the embroidery frame to move relative to the needle bar;

a memory configured to store sewing data for sewing a unit pattern on a sewing workpiece held by the embroidery frame, the unit pattern being formed by overlapping a first polygon and a second polygon, the sewing data including first data for sewing the first polygon and second data for sewing the second polygon, the second polygon being obtained by rotating the first polygon about a center of a virtual ring circumscribed about the first polygon; and a controller configured to perform:

a sewing data acquisition operation of acquiring the sewing data from the memory; and a unit pattern sewing operation of controlling the needle bar and the carriage based on the sewing data to sew the unit pattern on the sewing workpiece, the unit pattern sewing operation including:

performing a first operation of sewing the first polygon a first number of times based on the first data, the first number of times being two or more times; and performing a second operation of sewing the second polygon a second number of times based on the second data, the second number of times being two or more times, the virtual ring being circumscribed about both the first polygon and the second polygon, the second polygon having a side that intersects two sides extending from a vertex of the first polygon.

2. The sewing machine according to claim 1, wherein the controller is configured to, in the unit pattern sewing operation, perform the first operation consecutively the first number of times and then perform the second operation consecutively the second number of times.

3. The sewing machine according to claim 1, wherein the controller is configured to, in the unit pattern sewing operation, perform the first operation and the second operation alternately a plurality of number of times.

4. The sewing machine according to claim 1, wherein the memory is configured to store pattern data for sewing an embroidery pattern on the sewing workpiece, the embroidery pattern including a pattern indicated by stitches in a uniform direction, the embroidery pattern being a pattern different from the unit pattern;

wherein the controller is configured to further perform:

a pattern data acquisition operation of acquiring the pattern data from the memory;

an embroidery pattern sewing operation of sewing the embroidery pattern in accordance with the pattern data; and wherein, in a case where the embroidery pattern and the unit pattern are sewn, the controller is configured to perform the embroidery pattern sewing operation and then perform the unit pattern sewing operation.

5. The sewing machine according to claim 1, wherein the unit pattern includes a first-type unit pattern and a second-type unit pattern;

wherein the first-type unit pattern is sewn by performing the first operation consecutively the first number of times and then performing the second operation consecutively the second number of times;

wherein the second-type unit pattern is sewn by performing the first operation and the second operation alternately a plurality of times; and wherein the controller is configured to perform control to sew the first-type unit pattern and the second-type unit pattern in the unit pattern sewing operation.

6. The sewing machine according to claim 1, wherein the unit pattern includes a first-type unit pattern and a second-type unit pattern;

wherein the first-type unit pattern is sewn by performing the first operation consecutively the first number of times and then performing the second operation consecutively the second number of times;

wherein the second-type unit pattern is sewn by performing the first operation and the second operation alternately a plurality of times; and wherein the controller is configured to further perform:

acquiring a selected pattern that is the unit pattern selected from the first-type unit pattern and the second-type unit pattern; and sewing the selected pattern in the unit pattern sewing operation.

7. A non-transitory computer-readable storage medium storing sewing data, the sewing data being data in which position data and a sewing order are associated with each other, the position data indicating a position of a needle drop point that is a point of piercing a sewing workpiece with a sewing needle attached to a needle bar of a sewing machine, the sewing order indicating an order in which the sewing needle pierces the sewing workpiece at the needle drop point, a first polygon and a second polygon being overlapped to form a unit pattern, the sewing data including a first number of first data and a second number of second data, the first number being two or more, the first data indicating positions of first vertices of the first polygon as the position data, the position data of the first vertices being arranged in the sewing order, the second number being two or more, the second data indicating positions of second vertices of the second polygon as the position data, the position data of the second vertices being arranged in the sewing order, the second polygon being obtained by rotating the first polygon about a center of a virtual ring circumscribed about the first polygon, the virtual ring being circumscribed about both the first polygon and the second polygon.

8. The non-transitory computer-readable storage medium according to claim 7, wherein the first polygon is a first triangle having three vertices that are the first vertices; and wherein the second polygon is a second triangle having three vertices that are the second vertices.

9. The non-transitory computer-readable storage medium according to claim 8, wherein the first triangle and the second triangle are regular triangles having sides of a same length; and wherein the virtual ring circumscribed about the first triangle and the second triangle is a virtual circle.

10. The non-transitory computer-readable storage medium according to claim 9, wherein the second triangle is a regular triangle that is obtained by rotating the first triangle 180 degrees about a center of the virtual ring circumscribed about the first triangle.

11. The non-transitory computer-readable storage medium according to claim 7, wherein the first polygon and the second polygon are regular polygons having sides of a same length; and wherein the virtual ring circumscribed about the first triangle and the second triangle is a virtual circle.

12. The non-transitory computer-readable storage medium according to claim 11, wherein the second polygon is obtained by rotating the first polygon a particular angle about a center of the virtual ring; and wherein the particular angle is an angle that one of the second vertices is located on a median between two adjacent vertices of the first vertices.

13. The non-transitory computer-readable storage medium according to claim 7, wherein the first number is same as the second number.

14. The non-transitory computer-readable storage medium according to claim 13, wherein each of the first number and the second number is five or less.

15. The non-transitory computer-readable storage medium according to claim 13, wherein each of the first number and the second number is five.

* * * * *